US012644058B2

(12) United States Patent
Snider et al.

(10) Patent No.: US 12,644,058 B2
(45) Date of Patent: Jun. 2, 2026

(54) SYSTEM, METHOD, AND APPARATUSES FOR NEAR-ZERO EMISSION MODULAR OIL REFINERY WITH FLUE-GAS SEQUESTRATION

(71) Applicant: Designer Fuels, LLC, Reno, NV (US)

(72) Inventors: George E Snider, Vero Beach, FL (US); Darin Diorio, Wytheville, VA (US); Larry M Shultz, Los Angeles, CA (US)

(73) Assignee: CLEAN REFINERIES, INC., Edmond, OK (US)

( * ) Notice: Subject to any disclaimer, the term of this patent is extended or adjusted under 35 U.S.C. 154(b) by 161 days.

(21) Appl. No.: 18/584,063

(22) Filed: Feb. 22, 2024

(65) Prior Publication Data

US 2024/0287392 A1 Aug. 29, 2024

Related U.S. Application Data

(60) Provisional application No. 63/486,548, filed on Feb. 23, 2023.

(51) Int. Cl.

| | |
|---|---|
| ***C10G 9/42*** | (2006.01) |
| ***C10G 7/04*** | (2006.01) |
| ***C10G 7/06*** | (2006.01) |
| ***C10G 31/06*** | (2006.01) |

(Continued)

(52) U.S. Cl.

CPC ..... *C10G 9/42* (2013.01); *C10G 7/04* (2013.01); *C10G 7/06* (2013.01); *C10G 31/06* (2013.01); *C10G 31/10* (2013.01); *C10G 70/043* (2013.01); *C10G 2300/202* (2013.01); *C10G 2300/302* (2013.01); *C10G 2300/308* (2013.01)

(58) Field of Classification Search

CPC ... C10G 9/42; C10G 7/04; C10G 7/06; C10G 31/06; C10G 31/10; C10G 70/043; C10G 2300/202; C10G 2300/302; C10G 2300/308; C10G 7/00

See application file for complete search history.

(56) References Cited

U.S. PATENT DOCUMENTS

2021/0102126 A1* 4/2021 Dyer ..... C10G 55/04

* cited by examiner

*Primary Examiner* — Randy Boyer
*Assistant Examiner* — Juan C Valencia
(74) *Attorney, Agent, or Firm* — Berkeley Law & Technology Group, LLP

(57) ABSTRACT

A system for refining crude oil to minimize emissions of toxic compounds in the atmosphere during refining. The crude oil is treated with viscosity-reductant additives, reducing viscosity by up to 50% and increasing API gravity by more than 2 points. The method of spray-cracking and vacuum-flashing of crude oil, the system separates light and heavy end chains within the reactor. The vapor is condensed into designer fuels using a multi-stage horizontal reverse condensate-condenser or closed-loop distillation tower. Process heater directs flue gases through high-salinity fluids, such as a brine-processing device to capture, sequester, or mineralize the CO2, CO, NOx, and other contaminants from the flue gases. This results in a significant reduction in emissions, a further reduction to near-zero emissions (>95-98%) is achieved by the combination of (1) the closed loop processes, tank blanketing and capturing, sequestering and mineralizing emitted flue gases from the heater combustion-exhaust.

7 Claims, 9 Drawing Sheets

(51) Int. Cl.
*C10G 31/10* (2006.01)
*C10G 70/04* (2006.01)

SYSTEM, METHOD, AND APPARATUSES FOR NEAR-ZERO EMISSION MODULAR OIL REFINERY WITH FLUE-GAS SEQUESTRATION

TECHNICAL FIELD OF THE INVENTION

The present invention relates to a system for refining crude oil to minimize emissions of toxic compounds and sequestering flue gases.

BACKGROUND OF THE INVENTION

The properties of hydrocarbons depend on the number and arrangement of the carbon and hydrogen atoms in the molecules. Hydrocarbons containing up to four carbon atoms are usually gases, those with 5 to 19 carbon atoms are usually liquids, and those with 20 or more carbon atoms are solids. Crude oils range in consistency from water to tar-like solids, and in color from clear to black. An "average" crude oil contains about 84% carbon, 14% hydrogen, 1%-3% sulfur, and less than 1% each of nitrogen, oxygen, metals, and salts. Crude oils are generally classified as paraffinic, naphthenic, or aromatic, based on the predominant proportion of similar hydrocarbon molecules. Mixed-base crudes have varying amounts of each type of hydrocarbon. Refinery crude base stocks usually consist of mixtures of two or more different crude oils. The conventional energy-intensive oil refining process uses chemicals, catalysts, heat, and pressure to separate and combine the basic types of hydrocarbon molecules naturally found in crude oil into groups of similar molecules. The refining process rearranges their structures and bonding patterns into different hydrocarbon molecules and compounds.

Throughout the history of refining, various treatment methods have been used to remove non-hydrocarbons, impurities, and other constituents that adversely affect the properties of finished products or reduce the efficiency of the conversion processes. It is a generally accepted fact that SOx and NOx emissions from fossil fuel combustion affect human health, especially when combined with atmospheric aerosols that form "acid rain" and more harmful secondary pollutants (including toxic mercury, sulfur oxides, sulfuric acids, nitric acids, hydrogen peroxides) that are absorbed by floating particulate matter and dissolved in rain droplets to exacerbate local air pollution and change the chemistry of local water supplies. Countries today have decades of experience and scientific proof of the effects on agriculture, livestock, and humans from burning fossil fuels. No longer are governments tolerating the sun-blocking smog and respiratory harm to their populations caused by unregulated fossil fuel combustion emissions. Scientific studies worldwide estimate that SOx and NOx emissions from fossil fuels are responsible for the deaths of 10s of 1000s of children and the elderly, due to respiratory harm from fossil fuel combustion pollutants. Concern for the environmental effects of burning fossil fuels has recently turned to the global maritime shipping industry, where shipping pollution emissions of particulate matter (PM) smaller than 2.5 microns are estimated in recent studies to be responsible for 60,000 premature cardiopulmonary deaths every year as a consequence of ships burning high-sulfur low-purity bunker fuels. Low-grade ship bunker fuel (or fuel oil) can have more than 2,000-3,000 times the sulfur content of low-sulfur diesel fuels used in US and European automobiles. The International Maritime Organization (IMO) used such data to justify the enactment of its IMO-2020 regulations for the shipping industry to burn only low-sulfur bunker fuels to reduce harmful SOX and PM emissions from maritime sources. As the fuel market moves to a low-sulfur world, low-SOX bunker fuels, jet fuels, diesel fuels, and gasoline fuels will become the most in-demand fuels in the market. The global move to low-sulfur fuels is expected to reduce markets and demand for high-sulfur crude oil produced by Middle East-based Organization of the Petroleum Exporting Countries (OPEC) countries. "Sour oil"-producing countries, like Saudi Arabia, Iraq, UAE, Kuwait, and Mexico face a changing marketplace for oil, where their "sour" crude oil supplies may have a lower value because it costs refineries much more money to remove the sulfur than to buy other countries' low-sulfur crude oil at a higher price in the first place.

Based on the rising demand for sweet low-sulfur crude oil feedstock to meet the low-cost needs of global low-sulfur fuel refineries, oil producers must deliver environmentally-friendlier ways to refine raw crude oil, if they want to increase the number of oil refineries worldwide that would want to buy their crude. Near Zero-Emission Micro Oil Refineries can enable local markets to "make their fuels" and in the process reduce the retail cost of bunker, jet, diesel, and gasoline fuels to local consumers by removing the high cost of transporting those heavy fuels from 1,000s of miles away. Instead of importing tankers full of already-refined fuels that come burdened with high added transportation costs, a local Micro Oil Refinery could import just the crude oil, and from that raw material produce higher-value higher-purity fuels that can be sold at a local wholesale price that benefits all parties in a cleaner fuel value-chain. The Micro Oil Refinery (MOR) process is substantially different from the conventional pollution-intensive crude oil refining process that uses high-temperature vertical distillation columns to fractionate oil. The MOR achieves its near zero-emission refining status by not using open-air vertical distillation columns, but instead using a novel reverse horizontal condensing method and gas recycling, in a closed-loop or a vertical distillation column in a closed loop. All of the flue gases generated from the heat put into the process by the heaters are sequestered or undergo mineralization. By also removing the crude oil impurities separated by the process and removing the toxic combustion by-products allows the burning of the separated light-end gases for process-heat, enables the MOR's near zero refining emissions because it disposes of these separated impurities and process-heating combustion by-products into the final stage asphalt/residuum product. The advantage of the MOR crude oil processing technology is its near-zero emissions that can allow MOR units to be located anywhere in the world, and more quickly receive environmental permits to operate, without threatening the local environment with the toxic emissions that are usually associated with oil refineries. Until now, virtually all oil refineries in the world have been portrayed as huge toxic emission-belching behemoths that take much too long to receive environmental permits and which no informed human would want to live near or work downwind of. Public protests citing health concerns are why fewer and fewer refineries have been built around the world. But with the Micro Oil Refinery being a near-zero-emission facility, consumers desirous of reducing their retail cost of fuels should welcome being served by a local oil refinery near them that produces the fuels they need with no threatening refining emissions, and for which local consumers won't have to pay the ever-increasing fuel transportation shipping charges passed on to consumers by local fuel wholesalers, corporate customers, and retail gas stations.

Being the most environmentally friendly oil refining technology in the world should enable many cities and island nations to take advantage of their market size and fuel needs to justify the cost-effective installation of Micro Oil Refineries in their locales as the best means to reduce the cost of fuel to their local customers while sustaining a more productive and interconnected network of local jobs serving the local wholesale airport, marine/port, diesel fuel, and gasoline station owners. For private equity, investment banking, and institutional investors, the lower-cost Micro Oil Refinery technology represents a much lower economic and environmental permit risk than their financing of higher-cost, emissions-intensive, conventional oil refineries that can take a decade to receive environmental permits to operate as compared to a Micro Oil Refinery, with near-zero emissions, that can be environmentally-permitted to operate and start producing revenues years sooner.

Over the years, numerous prior arts and research-based advancements have received various methodologies, whose systems and strategies have been revealed for limiting the toxic gases emitted from oil refineries. The catalytic cracking methods of crude oils resulting in the separation of hydrocarbons and also techniques for desulfurization, and de-nitrification of crude oil have been previously studied by researchers. In various prior arts, conventional technologies were based on the hydro-cracking process of low-quality feed oil or crude oil. These processes undergo hydro-treatment reactions using several kinds of catalysts. The domestic hydro-cracking technology also received a large-scale industrial application. However, the hydro-cracking of a wide range of crude materials yields fuels of superior quality and other synthetic chemical crude materials. The hydro-cracking process and innovation became increasingly more thoughtful regarding the world's eminent crude oil owners and industries. Subsequently, many prior arts disclose the hydro-treating catalyst in the presence of hydrogen, kerosene, and gas oil. Some of the prior arts describe processes that involve the hydro-refining of any of the oil mixture of kerosene and gas oil and further purification done by hydrogenation using the same hydro-treating catalyst. In the early 1940s, another technique came under the knowledge which incorporated the alkylation process by using various catalysts to refine petrochemical feedstock to increase gasoline yields and to improve fuel characteristics.

In one of the closest prior art, US2006/0231462A1 which relates to a method and apparatus for improving crude oil using filtration media and pressure application for forcing the crude oil through the filter where cavitation is created. Specifically, it includes a pneumatic pressure source that transports crude into a separator. As the crude passes through the filtration media, it experiences cavitation effects. The cavitation effects impart mechanical and thermal energy that assists in breaking or cracking the hydrocarbons into more valuable lighter hydrocarbons. The cavitation is produced during a backflow of the crude oil through the filter, further forcing the crude oil through a series of filters. In one aspect, the invention transforms crude oil having an API gravity of 26 into crude oil having an API gravity of 35. The process entails improving crude oil filtration where successively the waste residuum is ejected from the crude oil. The system for improving crude oil using filtration media exerts a pressure differential between 150 and 300 psi depending on the viscosity of the fluid involved, which must be reduced.

In another prior art, CN107345150A discloses a process for hydro-processing heavy oil high nitrogen inferior. The method works under the hydrogenation reaction conditions, where the heavy oil feedstock is sequentially treated with a protecting agent, a contact de-metallization agent, a de-nitrification agent, the protecting agent, metal release agent. Each agent contains a de-nitrification catalyst which is supported on the catalyst support active metal components, where the protective agent, the release agent, and at least one of the metal catalyst support is modified to support the de-nitrification agent. The modified support contains an acidic stratification adjuvant in a carrier and is gradually increased from the particle surface to the center of the modified acidic support. The presence of water in the reactor may cause a significant portion of the de-metallization agent and metal oxides to precipitate from the liquid phases and thereby disrupt the process.

In another prior art, U.S. Pat. No. 7,276,152B2, which relates to a process of removing sulfur-containing compounds and nitrogen-containing compounds from liquid petroleum feedstock that are useful for the oxidative process. The extraction solvent used is ammonia and the extractor unit has a pressure in the range of 100 to 600 psig and a temperature that ensures that the ammonia solvent is in the liquid phase. The heavy and viscous sulfones and nitrogen oxides accumulate in the bottom of the solvent recovery Column. The process involves transferring the oxidized hydrocarbon feedstock stream into an evaporator or distillation column for carrying out the separation process and to remove the by-products including acids, acetone, and acetaldehyde which makes the entire operation an expensive process.

In conventional oil refineries, sulfur is generally removed after the crude oil has been fractionated. Sulfur removal typically comprises utilization of various desulfurization processes, often requiring extreme operating conditions, and incorporation of expensive equipment, often associated with high maintenance costs. Examples of prior art processes for conventional sulfur removal can be found in U.S. Pat. Nos. 1,942,054; 1,954,116; 2,177,343; 2,321,290; 2,322,554; 2,348,543; 2,361,651; 2,481,300; 2,772,211; 3,294,678; 3,402,998; 3,699,037; and 3,850,745, the disclosure of each of which is hereby incorporated herein in its entirety for all purposes not contrary to this disclosure.

In one of the closest prior art U.S. Pat. No. 4,885,080A, the invention discloses a process for producing a synthetic crude oil of improved properties by desulfurizing, denitrogenating, and de-metallizing a heavy crude oil feedstock by separating the crude oil into several fractions which are selectively hydro-treated. The feedstock is a crude oil having an average boiling point at least as high as 500° F., an API gravity less than 20 at 60° F., and containing at least 1 weight percent sulfur. The process entails initially vacuum or atmospheric fractionating a heavy crude charge stock to provide at least three liquid fractions including naphtha, distillate, and heavy residuum. The process includes a hydro-desulfurization zone which includes a very high temperature in the range from about 550° F. to about 850° F. and a hydrogen partial pressure from about 250 psig to about 900 psig. The desulfurized-demetallized residuum is then recombined with the naphtha and/or distillate fractions to produce the synthetic crude oil constituting the end product. Therefore, it is energy exhaustive process as the desulfurization zone alone operates at temperatures of 550° F. to 850° F. and pressure from 250 psig to 900 psig.

A prior art, U.S. Pat. No. 5,858,766A discloses a process for the biochemical conversion of a feedstock of heavy crude oils. More specifically, heavy crude oils are treated with modified and adapted biocatalysts including biologically defined and pure strains of bacteria which have been selected through nutritional stress under challenge growth processes to utilize for the growth complex hydrocarbon and heteroatom-containing compounds found in heavy crude oil. The process for upgrading heavy crude oil wherein saturated hydrocarbons of said heavy crude oil is from about 10.3% to about 19.2% by weight, said resins of said heavy crude oil is from about 25% to about 45% by weight, said asphaltenes of said heavy crude oil are from about 4.4% to about 56.0% by weight. The underlying biochemical process of the invention occurs at a pressure from atmospheric to about 2500 psi and contacting heavy crude oil with a bacterial strain occurs from 24 hours to 50 hours. However, it is a heavy process and requires extensive secondary and tertiary recovery technology. The problems that are mainly encountered with these processes include bacterial strain availability, economic value, and refinery wastes. Other problems linked to processes with contacting crude oil with bacterial strains include plugging of the reservoir rock by the bacterial mass in undesirable locations and acidification of the crude oil by the bio-production of hydrogen sulfide in the reservoir.

Another prior art, JP5346036B2, relates to the process of upgrading heavy crude oil to produce more valuable crude feedstock. To form a modified feed containing nitrogen and metal components, the hot pressurized acoustic critical water is contacted with the feedstock. The asphaltene components are reduced which increases middle distillate yield. The upgraded heavy Crude oil having a 27.4 API gravity combined with feed water in the presence of crude oil having a pour point of 34.3 or higher API gravity and 86° F. (30° C.) than, the modified oil/water mixture. The process operates at a high-temperature range of about 705° F. to about 1112° F. (374° C.~600° C.). The modified oil/water mixture is made in the absence of hydrogen and further, no catalyst is supplied from the outside. The presence of water in the oxidation reactor also causes a significant portion of the peroxides and organic oxides to precipitate out from the liquid phases. The presence of water in the reactor may sometimes disrupt the operation of the reactor.

One of the closest prior art, US2019/0040329A1, encompasses a multi-stage device for the production of a product of heavy marine fuel oil from distressed fuel oil materials. The device comprising pre-treating of the distressed fuel oil materials into a feedstock heavy marine fuel oil means for pre-treating being selected from the group consisting of various types of distillation columns. The process further includes the step of mixing a quantity of the pre-treated feedstock heavy marine fuel oil with a quantity of activating gas mixture to give a feedstock mixture and contacting with metal catalysts to form a process mixture. The process where the product heavy marine fuel oil has bulk properties of kinematic viscosity at 50° C. between the range from 180 mm2/s to 700 mm2/s; a density at 15° C. between the range of 991.0 kg/m3 to 1010.0 kg/m3, the total pressure is between 250 psig and 3000 psig, and the temperature is between 500° F. to 900° F. However, the process operates at a high pressure and a high temperature which is usually higher than the conventional techniques. The problem is that distressed fuel oil and residues contain high sulfur concentrations and nitrogen; asphaltenes show a tendency to form carbon or coke on the high-cost catalyst, thereby altering its function and wasting money in the process.

In another prior art US2017/0260461A1, a process for separation of the lighter hydrocarbon fractions from the heavier fractions of hydrocarbon oil feedstock which performs sparging and reverse distillation techniques known in the art. Such inventions use costly heaters to separate asphaltenes and paraffins from crude oil. Further, prior art use of the sparging technique, performed in the reactor tank for cracking the crude oil, is comparatively inefficient, while the added cost of the sparging gases (like methane, helium, nitrogen, butane, carbon dioxide, or any other inert gas introduced into the reactor vessel along with crude feedstock to complete the cracking process) only further increases the cost of the refining processes that use sparging.

In another prior art, US2008/0253426A1, the invention relates to a method of assaying a hydrocarbon-containing feedstock, such as refinery feedstock crudes, synthetic crude oils, partially refined intermediate fractions such as a residue component or a cracked stock component, bio-components or blends thereof, and petroleum exploration pre-production test well samples. The method generally measures the boiling profile and other properties of the hydrocarbon-containing feedstock and transmits the measurements made to a processor capable of reconstructing a determinative assay. The method is capable of measuring the properties selected from the group consisting of density, specific gravity, total acidic number, pour point, viscosity, sulfur content, metal content, nitrogen content, and combinations thereof. Therefore, a micro oil refinery automation system must be capable of calculating the extraction amounts of the left-over heavy oil residuum, left-over asphaltenes, and the left-over liquified Paraffin from the heavy oil Residuum to analyze the residual wastes. Further, automation systems must be able to measure, record, and count all the compounds that are first entering and subsequently exiting out of the process.

In yet another prior art U.S. Pat. No. 11,214,743B2, the invention relates to a system and process for refining crude oil to produce higher purity cleaner burning targeted fuels with reduced emissions. The crude oil may be treated with viscosity-reductant additives, which reduce viscosity by up to 50% and increase API gravity by more than 2 points. The method of spray-cracking and vacuum-flashing of crude oil separates light end chains and heavy end chains inside the reactor. The GVF centrifuges are configured to separate targeted fuels of desired density value as per their ideal fuel densities, which carry out centrifugal polishing to generate targeted fuel products of desired density and hydrocarbon molecules of desired purity values. These designer fuels are further treated with desulfurization additives. However, the process is inefficient for refining crude oil to provide near-zero emissions.

The aforementioned inventions in the field of crude oil processing also discuss crude oil separation processes, apparatus, and techniques. The crude oil processing methods known in the above prior arts possess several limitations and drawbacks that need to be overcome. The prior arts have limited scope to address the problems encountered and they are less efficient in minimizing the SOX and NOx emissions, increasing fuel lubricity and burn-efficiency in engines. Moreover, they are incapable of achieving the so-called targeted low-sulfur and low-nitrogen emission fuels. Most of the crude oil refining process utilizes high pressure and elevated temperature conditions for cracking of hydrocarbon. Moreover, most of these prior art processes use costly heaters, requiring costly fuels for high-temperature heat to break the asphaltenes and paraffin from the crude. And these prior art processes are inefficient, because they do not completely recycle, nor use, the exhaust gases and left-over contaminants from their processes into a valuable residuum or asphalt by-product. While such prior art processes and techniques endeavor to solve one problem, they create other problems due to their processes being too energy-intensive cost-intensive uneconomical inefficient, or more pollutive.

To overcome the aforementioned problems, there is a strong need and demand for a better approach to designing a crude oil refining process to cost-efficiently extract high-purity and cleaner-burning fuels produced from any kind of heavy or light, sweet or sour crude oil feedstock with reduced or minimal refining emissions and environment impact.

There is also a strong need for oil refineries to become more eco-friendly and carbon-neutral by eliminating or capturing refinery flue-gas emissions of GHG, CO2, CO, NOx, and other contaminant by-products of fossil-fuel combustion which refineries currently release to the local atmosphere, and downwind communities.

There is also a strong need for an oil refinery flue-gas sequestration process that can utilize and convert a nearby source of high-salinity water resources, like oil-field produced-water that needs to be disposed of, or a nearby source of ocean water, that can be used to further reduce oil refinery emissions to near-zero emissions.

"Produced Water" is a by-product during extraction of oil and gas production and fracking. Produced water is dirty, brine water, contaminated with a high-concentration solution of salts (typically sodium chloride or calcium chloride) and other soluble and non-soluble oil/organics, suspended solids, dissolved solids, and various chemicals used in the production process that all come out of the ground/well during oil/gas/fracking/production. As contaminated water, produced water is usually disposed of by injection into the ground into deep injection wells. Unfortunately, high-pressure injection is now linked to earthquakes So, there is a great need to reduce the volumes of dirty produced water injected into the ground by the oil industry.

There is also a need for a system that can convert a high-disposal-costing waste product into a higher-value carbon-sequestering product that earns Carbon Credits and helps the environment.

SUMMARY OF THE INVENTION

This section provides a general summary of the disclosure and is not a comprehensive disclosure of the full scope of all its features.

In particular, the present invention relates to a modular or micro/mini crude oil refinery that processes 10,000-100,000 barrels of crude oil per day, and more particularly, relates to an environmentally-friendlier and safer, low-temperature and low-pressure system, process and apparatus for refining crude oil with near zero refining emissions to produce higher-purity, cleaner-burning bunker fuels, jet fuels, diesel fuels, and gasoline fuels with near zero combustion emissions of SOx and NOx, using flue gas sequestration, and using a software-controlled automation method to control the production of these designer fuels.

The invention overcomes the above problems by disclosing a cost-efficient system and a process of refining crude oil to extract higher-purity, cleaner-burning designer fuels, like diesel fuel, gasoline fuel, jet/kerosene fuel, bunker fuel, and a chemical-rich asphalt/residuum, from any kinds of heavy or light, sweet or sour crude oil feedstock, to produce reduced combustion emissions of SOx, NOx and other unwanted pollutants into the atmosphere.

In the preferred embodiment of the present invention, a system for refining crude oil to produce high-purity, cleaner-burning designer fuels in a micro-crude oil refinery with near zero reduced refining emissions is described. The system comprises four sections: a crude section, a vapor section, a condensate section, and a flue-gas sequestration section. The crude section comprises of following devices: a crude oil stock tank, a plurality of heat exchangers, a chemical additive tank, a plurality of centrifugal pumps or positive displacement pumps, a plurality of valves, and a reactor. The crude oil stock tank stores the crude oil feedstock. The plurality of heat exchangers heats the crude oil to the optimum temperature range according to the flow of crude oil to different devices and the movement of crude oil is controlled by the plurality of valves. The chemical additive tank stores the viscosity-reductant additive which is contacted with the crude oil to break down heavy-chain hydrocarbons into light-chain hydrocarbons. The pre-treatment of the crude oil with a low-cost viscosity-reductant additive reduces the viscosity and increases the API gravity of the crude oil. The centrifugal pump or positive displacement pump is configured to properly mix the crude oil with the viscosity-reductant additive. The hot crude oil enters into the reactor which is designed to carry out two novel methods of spray cracking and vacuum flashing of the crude oil to separate heavy chain hydrocarbon, light chain hydrocarbon, and by-products. This method of spray-cracking and vacuum-flashing uses less energy is more efficient than conventional methods, and can be completely automated.

The condensate section comprises a multi-stage horizontal reverse condensate condenser or a closed loop vertical distillation tower, a plurality of cooling equipment, a plurality of fuel stock tanks, a plurality of GVF centrifuges, a plurality of Fraction sulfur reducer (FSR), a plurality of output storage tanks. An important aspect of the present invention is a horizontal reverse condensate method or the closed loop vertical distillation tower to efficiently separate different fuel fractions of crude oil. The light chain hydrocarbon coming from the reactor enters into the multi-stage horizontal reverse condensate condenser or a closed loop vertical distillation tower in the form of vapor. The multi-stage horizontal reverse condensate condenser is configured to comprise at least three stages to condense the vapor into targeted fuel products. The cooling equipment is attached to each stage of the reverse condensate condenser to condense the vapor into targeted fuel products. The condensed fuel products get collected into each of the respective fuel stock tanks. The targeted fuel products pass through each of the GVF centrifuges which are configured to operate by density differentials to separate targeted fuels of desired density value as per the ideal fuel densities in the range from 0.7 kg/m3 to 1010 kg/m3 at a temperature of 15° C. The fuels are subjected to centrifuge polishing to generate targeted fuel products of desired density and hydrocarbon molecules of desired purity values. The hydrocarbon molecule purity is enhanced by removing the unwanted burn-inhibiting impurities in crude oil, whose molecular densities are outside the density value of the desired fuel molecules and are therefore rejected from the centrifuges. It further comprises an additive storage tank that stores an emissions-reductant additive. The targeted fuel products are contacted with an emissions-reductant additive that is injected out from the additive storage tank to further remove unwanted pollutants from the designer fuels to reduce SOX and NOX emissions. Finally, these designer fuels and by-products are collected into respective output storage tanks and are sent for sale to retailers or wholesale markets. The vapor section comprises a vapor trap tank, a plurality of separators, a plurality of blowers, and a plurality of process heaters. The vapor and gases that are not condensed in the multi-stage horizontal reverse condensate condenser are collected into the vapor trap tank. The plurality of blowers is configured to increase the velocity and pressure of gases and vapor released from the vapor trap tank. The plurality of process heaters is configured to burn the gases extracted from processed crude oil. The separator removes any entrapped non-condensable gases before passing the gases into the plurality of process heaters. The flue gas sequestration section comprises a thermal heater, a flue gas cooler, a bath of seawater, produced water, solvent, or brine. The flue gases from the thermal heaters are passed through a gas cooler to condition them for $CO_2$ capture. Subsequently, the flue gases pass through the bath of seawater, producing water, solvent, or brine to absorb $CO_2$. The brine is configured to convert $CO_2$ into carbonates, specifically Sodium Bicarbonate. These carbonates assist in eliminating the remaining traces of harmful substances from the flue gases.

In another embodiment, the designer fuels are selected from diesel fuel, bunker fuel, jet/kerosene fuel, naphtha fuel, gasoline fuel, grade 2 diesel fuel (#2 diesel), and grade 4 diesel fuel (#4 diesel). The diesel fuel extracted from the process is grade 2 diesel fuel (#2 diesel) and the bunker fuel extracted from the process is grade 4 diesel fuel (#4 diesel). The different grade of diesel fuel is based on the cetane number of the fuel. The by-products obtained from the processed crude oil are selected from asphalt, paraffin, and chemical-rich residuum. The system is a closed-loop system with near zero reduced crude oil refining emissions because the system recycles the crude oil to extract all the components separated and released from the crude oil feedstock and all the gases extracted from the crude oil process are utilized within the system to burn in the process heaters. Flue gases from the process heaters are captured or passed through high-salinity seawater/produced water/brine or solvent to sequester or mineralize the $CO_2$ and other flue-gas chemicals into the saline water or solvent.

In the preferred embodiment of the present invention, the embodiment provides a process for refining crude oil to produce designer fuels with desired hydrocarbon-chain configurations that are predominantly free from attachment of impurities, that burn more efficiently and with reduced emissions, comprising four stages: a crude stage, a vapor stage, a condensate stage, and a residuum stage. The crude stage comprises the initial flow of the crude oil from the crude oil stock tank with an ambient temperature of 120-200° F. and an ambient pressure of 100-200 psi. The crude is passed through the centrifugal pump or a positive displacement pump, which raises the pressure of the crude oil to 200-1000 psi. The crude oil from the centrifugal pump or positive displacement pump is either passed to a bunker fuel stock tank or the crude oil is passed through the heat exchanger. The movement of crude oil is controlled by a plurality of valves. In the bunker fuel stock tank, the crude oil comes in contact with the viscosity-reductant additive selected from Surfsol solvent, surfactants, emulsions, solvent, or combination of solvents, which are injected from the viscosity-reductant additive storage tank. The centrifuge pump properly mixes the viscosity-reductant additive with the crude oil. The crude oil is pre-heated in the pre-heat heat exchanger to the temperature of 200-500° F. which is connected to the first stage of a multi-stage horizontal reverse condensate condenser. Then, the crude oil is sent into the reactor in either of two ways to raise the temperature to an optimal temperature of 200-600° F. One of the ways involves passing the crude oil through a pair of electric heaters or through a plurality of heat exchangers controlled by a plurality of valves to raise the temperature of crude oil to an optimal temperature of 200-600° F. The hot crude oil enters the reactor, where the pressure inside the reactor is in the range of less than 0 to 29 inches of mercury Hg. The crude oil enters through a plurality of nozzles and process devices into the reactor which reduces the size of crude oil to 10-120 microns to form atomized crude particles. The atomized crude particles are sprayed into the vacuum condition at the pressure range from 200-1000 psi and temperature range of 200-600° F. which results in spray-cracking and vacuum-flashing of the atomized crude particles, which separates the atomized crude particles into light end chains and heavy end chains. The light end chains pass through the separator located inside the reactor and enter into a multi-stage horizontal reverse condensate condenser or a closed loop vertical distillation tower in vapor form and the heavy end chains fall through the sides of the reactor and are collected into the sump of the reactor as a residuum.

The vapor stage comprises the movement of vapor from the multi-stage horizontal reverse condensate condenser or a closed-loop vertical distillation tower into a vapor trap tank. The light end chain which does not condense in the condenser or tower is recovered into the vapor trap tank. These gases collected in the vapor trap tank are either passed through a vapor recovery unit (VRU) into a process heater or the gases are recycled through a pair of methane heaters and sent into the reactor. These gases pass through the small blower to a vapor recovery unit (VRU) and into the process heater and are burned for the process thermal heat. The flue gases from the heaters are then removed. The gases, like methane, pass to a pair of methane heaters using a pair of main blowers that increase the velocity and pressure of the gas flow. These gases coming from the methane heater are heated to a temperature equal to the temperature inside the reactor before entering the reactor. The gases enter into the reactor through a plurality of nozzles and process devices and these gases carry the atomized crude particles with carrying velocity range of 3-12 feet per second to the separator inside the reactor. The light end chains in the form of vapor passes through the separator located inside the reactor and the heavy end chains are collected into the sump of the reactor.

The condensate stage comprises the passage of vapor into the multi-stage horizontal reverse condensate condenser or closed loop vertical distillation tower where the vapor condensed into respective fuel products. The multi-stage horizontal reverse condensate condenser has at least 3 stages or compartments to condense the vapor, where the outputs from all the stages are based upon the inlet temperature coming from the cooling medium. The inlet temperature of the vapor coming from reactor 200-600° F. is condensed by reducing the temperature of the vapor to the optimum temperature range from 200-150° F. using a cooling medium from the pre-heat heat exchanger to form the diesel fuel in the first stage of the multi-stage horizontal reverse condensate condenser. The second stage takes vapor with an inlet temperature of 200-150° F. from the first stage and reduces the temperature to an optimum temperature range of 170-50° F. using a fin fan or similar device to obtain the jet fuel or kerosene in the second stage. Further, the third stage takes the inlet temperature of the vapor in the range of 170-50° F. from the second stage and reduces the temperature to the optimum temperature range from 60-20° F. using chillers or a similar device to obtain the naphtha fuel or the gasoline fuel.

The vapor from the first stage is collected as diesel fuel into the diesel fuel stock tank. The vapor from the second stage of the multi-stage horizontal reverse condensate condenser is collected as jet fuel into a jet fuel stock tank or as kerosene in the kerosene stock tank. The vapor from the third stage of the multi-stage horizontal reverse condensate condenser is collected as the naphtha fuel or the gasoline fuel into a naphtha or gasoline stock tank. Moreover, the bunker fuel is extracted from the reactor and collected into a bunker fuel stock tank. The asphalt extracted from the reactor is collected into an asphalt stock tank. The designer fuels from the respective stock tank pass through the plurality of centrifugal or positive displacement pumps. The designer fuels are then passed into a gas void fraction (GVF) centrifuge to remove unwanted carbon chains and impurities based on their density to improve the burning efficiency and reduce toxic emissions. The GVF centrifuge operates by density differentials to separate designer fuels of the desired density value based on the ideal densities of the designer fuels. It carries out centrifugal polishing to generate designer fuels of desired density and hydrocarbon molecules of desired purity values. The designer fuels are re-circulated from the gas void fraction (GVF) centrifuge back into respective stock tanks using the plurality of valves. These designer fuels are then sent through the fraction sulfur reducer (FSR), where each of the designer fuels comes in contact with the desulfurization ester additives which reduce combustion emissions like SOx and NOx from the fuel products. Finally, the diesel fuel from the FSR is collected into a diesel fuel output storage tank. The bunker fuel coming from the FSR is collected into a bunker fuel output storage tank. The jet fuel/kerosene coming from FSR is collected into a jet/kerosene fuel output storage tank. The jet fuel and kerosene fuel extracted from the process are dependent on the carbon chain of the processed crude oil. The naphtha fuel and the gasoline fuel are separated from each other. The separation is carried out by removing the unwanted carbon chains and pollutants from the naphtha fuel and the purified fuel is then pumped as the gasoline fuel. The naphtha fuel is collected into a naphtha fuel output storage tank and gasoline fuel is stored into a gasoline fuel output storage tank.

The residuum stage comprises the following steps: the residuum collected in the sump of the reactor is re-circulated back into the reactor for further extraction. The residuum is sent for primary processing by re-circulating throughout the process to obtain a first residuum. The residuum is sent from the sump of the reactor through the plurality of centrifugal or positive displacement pumps and a plurality of heat exchangers for recirculation. The first residuum is sent to a secondary processing, where the first residuum is further re-circulated throughout the process to finally obtain a chemical-rich residuum. Finally, the asphalt is extracted from chemical-rich residuum which is collected into an asphalt output storage tank. Paraffins in liquid form are also recovered from the chemical-rich residuum. The bunker fuel collected in the sump of the reactor is sent to the bunker storage tank.

In another embodiment, the viscosity-reductant additive selected from Surfsol solvent, surfactants, emulsions, solvent, or combination of solvents reduces crude oil viscosity by up to 50% and increases API gravity by more than 2 points. This viscosity-reductant additive treatment leaves only the lighter-end carbon chains that require less energy to process, since many of the contaminants, like asphalt and paraffin, attached to the carbon chain molecules have been removed by breaking the bonds between them after the treatment with viscosity-reductant additive, putting these hydrocarbons back into solution for further processing.

In yet another embodiment, the desulfurization ester additive comprises an ester solvent. The ester solvent is selected from the group of methyl octanoate, methyl laurate, trimethylolpropanetrilaurate, pentaeythritoltetralaurate and dipentaerythritolhexaheptanoate. In an embodiment, the desulfurization ester additive is added at a ratio of 1 ounce of the desulfurization ester additive to 10 gallons of the designer fuel. The ester additive reduces the emissions comprising SOx by up to 40% and NOx by up to 10% from the combustion of the designer fuels.

In another embodiment, the process heaters are heated with utility-grade natural gas, when there is a shortage in the aromatic gases extracted from the process. To make up for such a shortfall, the process opens the plurality of valves to deliver the utility-grade natural gas into the process heaters.

In another embodiment, the process of production of the designer fuels is based on the input density of the crude oil and the output density of the designer fuel. The GVF centrifuges in the process operate to achieve the ideal fuel densities of the designer fuels in the range from 0.7 kg/m3 to 1010 kg/m3 at a temperature of 15° C.

In another embodiment, the process of refining crude oil to produce designer fuels is a closed-loop process. All combustible by-products of the processes are recovered in a closed-loop and recycled to reduce the operating temperatures, pressures, heat, and electricity costs of the fuel-making process. The process optimizes closed-loop energy efficiency by recycling all of the components separated from and released by the crude oil in the process. The combustible hydrocarbon gases are utilized within the process, for flame-combustion in the process heaters, and for mixing with, and breaking down, down longer-chain hydrocarbon molecules.

One of the preferred embodiments is a method for automating the daily selection of the designer fuels from the process which comprises the following steps. The first step involves the electronic-tracking of crude oil feedstock delivered to a refinery. Then, the physical and chemical characteristics of the crude oil feedstock are analyzed. The next step is to determine the current market value for each bunker fuel, jet fuel, diesel fuel, naphtha fuel, gasoline fuel, and chemical-rich residuum/asphalt. Based on these characteristics and market value, the most valuable designer fuels and chemical-rich residuum obtained from the crude oil feedstock are calculated. Further, the amount of the first residuum to be subjected to the secondary processing is calculated. Then, the amount of the chemical-rich residuum obtained after the secondary processing is determined and calculated. The amount of asphaltenes and paraffins in liquid form to be extracted from the chemical-rich residuum is calculated. The next step is changing the output from the process to produce the most valuable designer fuels and the chemical-rich residuum. The output ratios of the designer fuels and the chemical-rich residuum by volume are calculated on each day according to the highest values. Finally, metering the processing and sale of the designer fuels and the chemical-rich residuum by recording weights and volumes of inputs of crude oil feedstock, inputs of the Surfsol solvents and the desulfurization ester additive, electrical and thermal energy inputs and the corresponding designer fuels and the chemical-rich residuum outputs. Therefore, the process embraces an excellent method of automation of the crude oil processing for tracking, storing, and converting a given input-density of crude oil into a given output-density of refined fuels, according to the real-time market value of each potential ratio of fuel products that can be produced based on the composition of input crude oil feedstock.

In another embodiment, the physical and chemical characteristics of the crude oil feedstock are selected from the group of Viscosity, API Gravity, Sulfur-content, Paraffin-content, Asphaltene-content, Aromatics-content, Water-content, Sediment-content, vanadium-content, and nickel-content. In one of the embodiments, the method for automating the daily selection of the designer fuels is performed using a production auditing or accounting control system operated with a software program. The production auditing or accounting control system calculates profitable ratios of the most in-demand designer fuels based on the physical and chemical characteristics of the input crude oil feedstock daily.

In one of the preferred embodiments, a reactor apparatus for spray-cracking and vacuum-flashing of crude oil in a system for refining crude oil to produce high purity, cleaner-burning designer fuels with near zero reduced refining emissions is disclosed, comprising the following components: a plurality of nozzles designed to reduce the molecular size of the crude oil to form atomized crude particles having the molecular size from 10-120 microns, which are sprayed at a pressure range from 200-1000 psi and having a temperature range from 200-600° F. The pressure maintained inside the reactor is from 0-29 inches of Hg. The atomized crude particles are sprayed into a vacuum condition inside the reactor resulting in the spray-cracking and vacuum-flashing of the atomized crude particles. Further, the reactor has a first input configured to receive gases and vapor from the first main blower, and a second input configured to receive gases and vapor from the second main blower. The gases and vapor from the first input and the second input carry the atomized crude particles at a carrying-velocity from 3-12 feet per second. It further comprises a separator located inside the upper portion of the reactor to separate light chain hydrocarbons and heavy chain hydrocarbons from the crude oil where the light chain hydrocarbons pass through the separator, and the heavy chain hydrocarbons are forced to fall through the sides of the reactor into a sump of the reactor. A plurality of pumps is connected to the sump of the reactor, and the heavy chain hydrocarbon from the sump is re-circulated back into the reactor using a recirculation pump to further extract the designer fuels and by-products. Each of the pumps is arranged to separate the designer fuels and the by-products. A plurality of output storage tanks is connected to the sump of the reactor to store the different designer fuels and by-products obtained from the reactor.

In one of the preferred embodiments, a horizontal reverse condensate condenser apparatus in a system for refining crude oil to produce high purity, cleaner-burning designer fuels with significantly reduced near-zero refining emissions is disclosed. The horizontal reverse condensate condenser apparatus comprises at least three stages, or fuel compartments, to separate the crude oil into targeted fuel products. Each of the stages or the compartments is connected to cooling equipment, like a fin fan, chiller, heat exchanger, and similar cooling devices. Each of the cooling equipment sends a cooling medium to its connected fuel compartment or stage to condense the vapor of the crude oil into the targeted fuel product for that compartment stage. Moreover, the horizontal reverse condensate condenser apparatus is configured to direct the flow of the vapor in a horizontal direction to condense the vapor at different temperatures into separate fuel compartments or stages, in which condensed fuel droplets get collected at the bottom of the fuel compartment stages.

In another embodiment, the horizontal reverse condensate condenser apparatus comprises three stages or fuel compartments. The inlet temperature of the vapor from the reactor, in a range from 200-600° F., is reduced to an optimum temperature range from 200-150° F. to form a diesel fuel in the first stage or compartment of the condenser apparatus. The second stage or compartment takes vapor with the inlet temperature in the range of 200-150° F. from the first stage and reduces the temperature to the optimum targeted temperature range of 170-50° F. to obtain jet fuel or kerosene fuel. The third stage or compartment takes vapor with the inlet temperature in the range of 170-50° F. from the second stage and reduces the temperature to the optimum temperature range from 60-20° F. to obtain a naphtha fuel or a gasoline fuel.

In another embodiment, the distillation tower works similarly to a conventional distillation tower design with the exception that the tower is completely enclosed within the ZTE-MOR closed-loop system. The vapor enters the tower under vacuum and the light fractions rise to their condensable level and are collected in a plurality of different fractionation trays.

Additional aspects and advantages of the present disclosure will become apparent to those skilled in this art from the following detailed description, wherein only illustrative embodiments of the present disclosure are shown and described. The present disclosure is capable of other and different embodiments, and its several details are capable of modifications in various obvious respects, all without departing from the disclosure. Accordingly, the drawings, descriptions, and examples in this summary are intended for purposes of illustration only and are not intended to limit the scope of the present disclosure.

BRIEF DESCRIPTION OF THE DRAWINGS

The embodiments herein will be better understood from the following detailed description of the drawings, in which:

FIGS. 1A-1D illustrates enlarged quadrants of FIG. 1, wherein FIG. 1A illustrates the lower right quadrant and illustrates primarily the section of initial crude flow through the process;

FIG. 1B illustrates the upper right quadrant and illustrates primarily the reactor section and outputs of the bunker fuel and asphalt from the reactor;

FIG. 1C illustrates the upper left quadrant and illustrates primarily the multi-stage horizontal reverse condenser section and corresponding outputs from each stage; and FIG. 1D illustrates the lower left quadrant and illustrates primarily outputs of designer fuels through the gas void fraction (GVF) centrifuges and Fraction sulfur reducer (FSR) into the respective output storage tank.

DETAILED DESCRIPTION

The following description includes the preferred best mode of one embodiment of the present invention. It will be clear from this description of the invention that the invention is not limited to these illustrated embodiments but that the invention also includes a variety of modifications and embodiments thereto. Therefore, the present description should be seen as illustrative and not limiting. While the invention is susceptible to various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

The articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

The embodiments herein achieve this by providing a system and process of refining the crude oil feedstock into high purity, high burning efficiency designer fuels namely Jet fuel/Kerosene fuel, diesel fuel (#2 diesel fuel), gasoline fuel, naphtha, bunker fuel (#4 diesel fuel) and chemical-rich residuum with reduced crude oil refining emissions.

Figure 1:
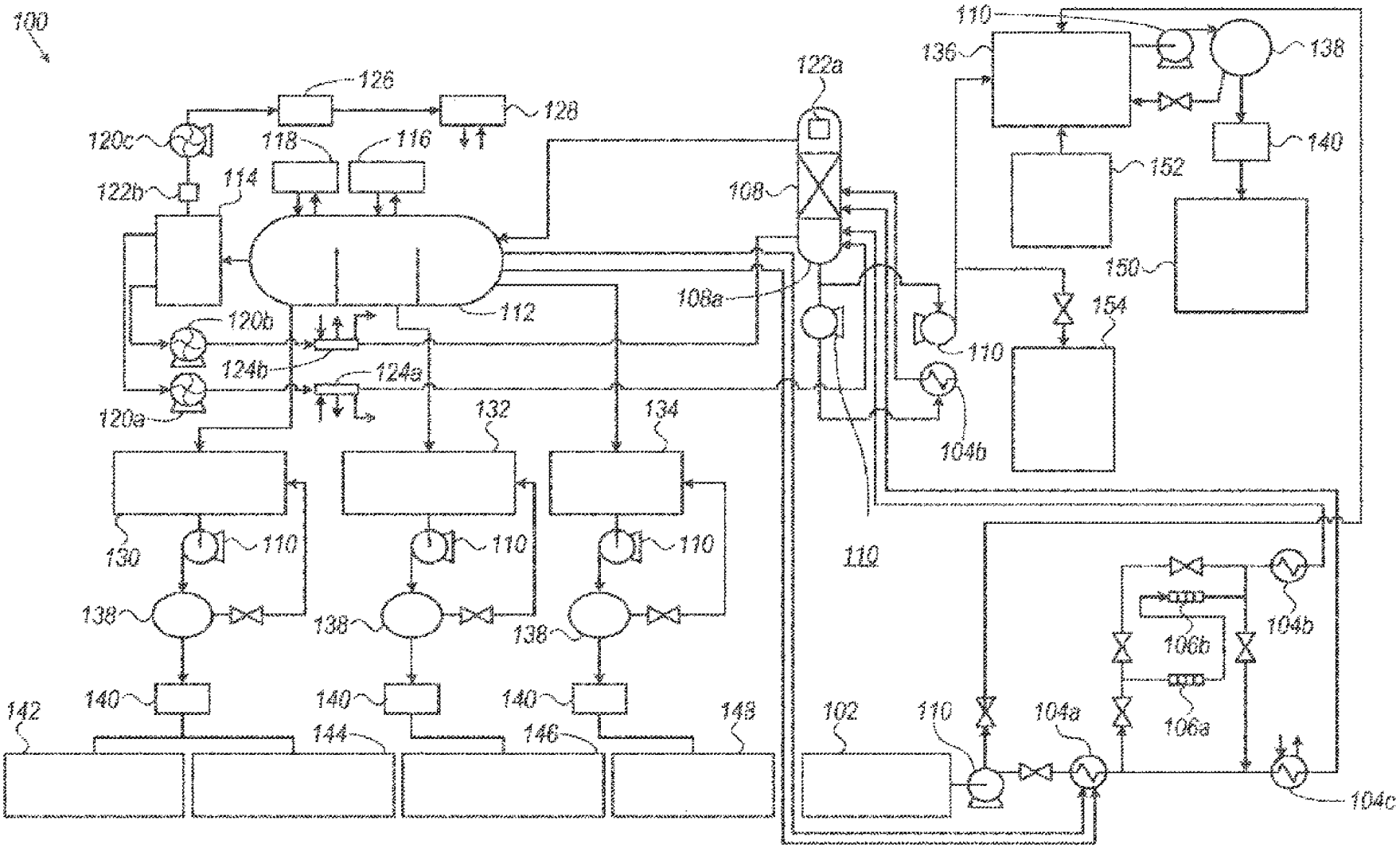
FIG. 1 illustrates a process flow diagram of an embodiment of the invention.
Figure 1A:
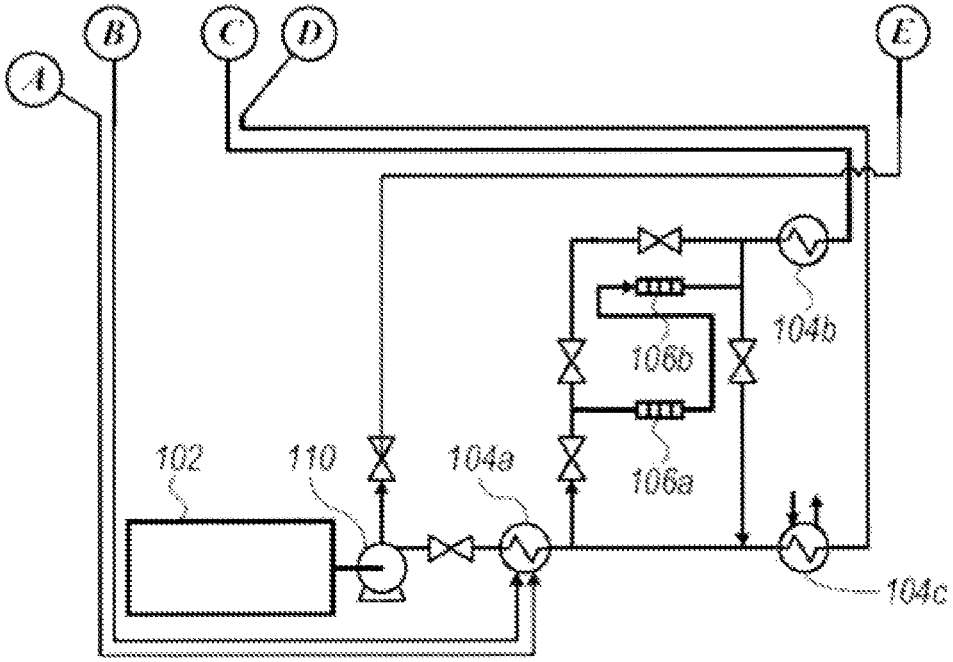
Figure 1B:
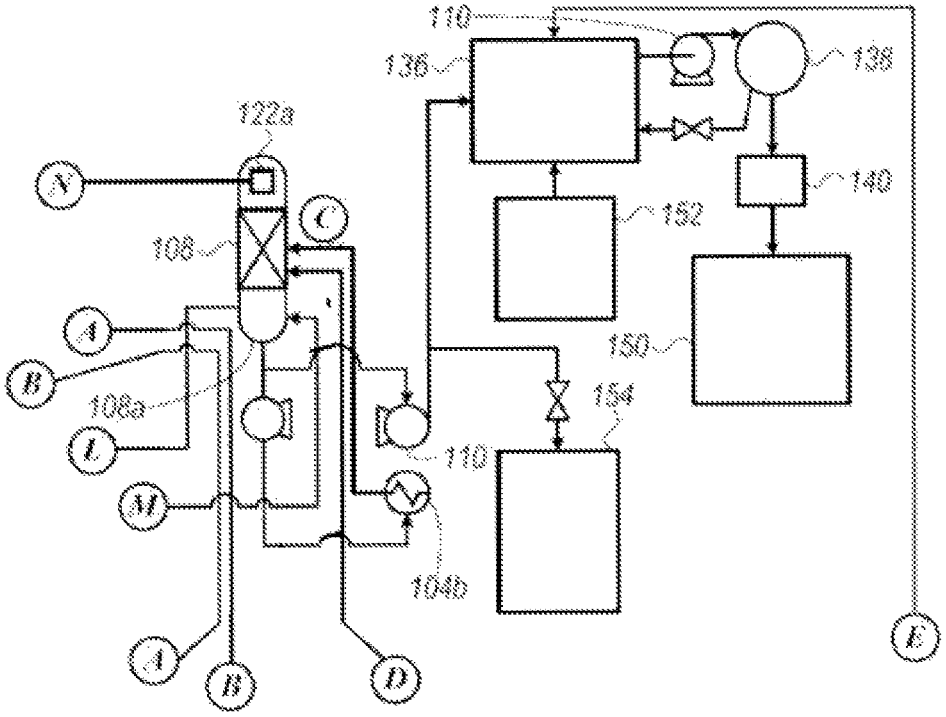
Figure 1C:
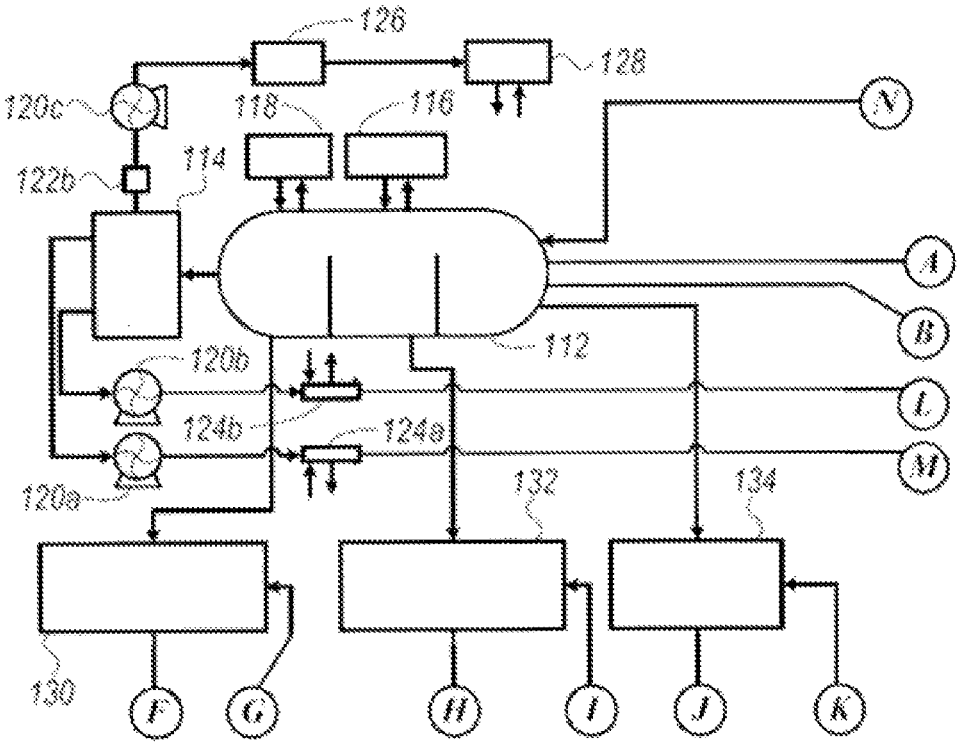
Figure 1D:
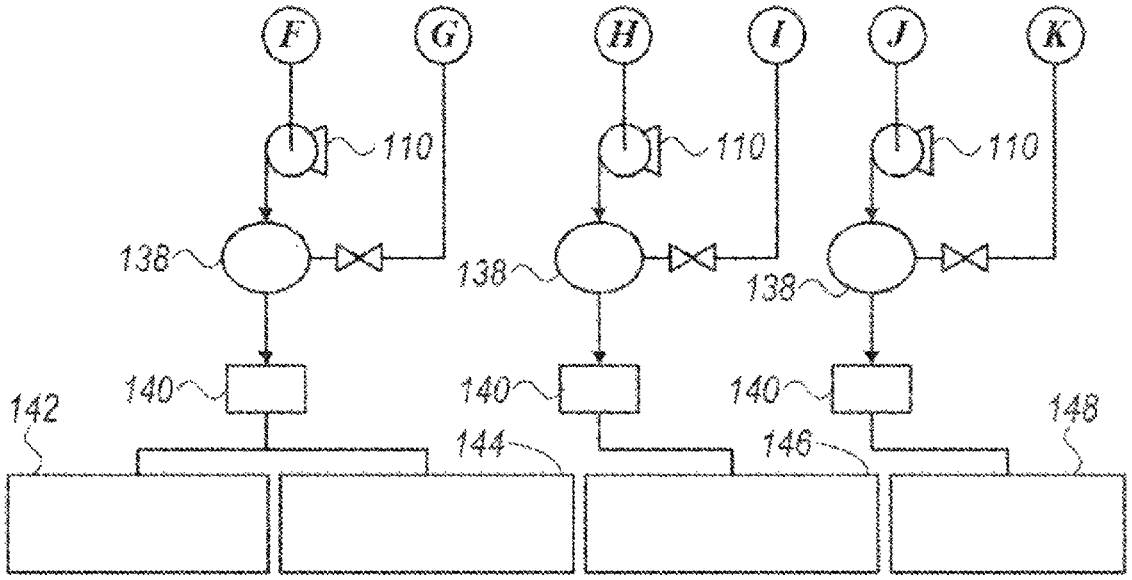

FIG. 1 is a flow diagram of the process (100) for refining crude oil to produce higher-purity, cleaner-burning designer fuels in a micro-crude oil refinery. FIGS. 1A-1D are enlarged quadrants of FIG. 1, wherein FIG. 1A is the lower right quadrant, FIG. 1B is the upper right quadrant, FIG. 1C is the upper left quadrant and FIG. 1D is the lower left quadrant. The connections between these quadrants are marked by unique encircles with capital letters A-P, each letter marking the continuity of the respective line across the corresponding edges of adjacent quadrants. Thus each line may be traced both within FIG. 1 and within and between FIGS. 1A-1D. Reference numbers of components are identical between FIG. 1 and FIGS. 1A-1D.

FIG. 1A illustrates the initial flow of crude oil through the process (100). The crude oil coming from the crude oil stock tanks (102) with an ambient temperature of 200° F. and pressure of 100-200 psi goes into the centrifugal pump or a positive displacement pump (110) where pressure is raised to 200-1000 psi. The crude oil from the centrifugal pump or positive displacement pump (110) may either flow to a pair of electrical heaters (106a &106b) for thermal cracking or to a heat exchanger (104) in which the movement of crude oil is controlled by a plurality of valves. When the crude oil passes through the preheat heat exchanger (104), it is preheated from the first stage of the multi-stage horizontal reverse condensate condenser (112) to 200-500° F. Then, the hot crude oil may either pass through a first path or the second path to raise the temperature to 200-600° F. When the crude takes the first path, it passes through the first electric heater (106a) and the second electric heater (106b) controlled by a plurality of valves passes through the heat exchanger (104) and reaches the reactor (108). When the crude takes the second path, it passes directly through another heat exchanger (104) heated using thermal fluids and enters into the reactor (108).

FIG. 1B illustrates the reactor section and outputs of the bunker fuel and asphalt from the reactor. The crude oil from the crude oil stock tanks (102) may pass through the centrifugal pump or positive displacement pump (110) to a bunker fuel stock tank (136), where the crude oil comes in contact with a Surfsol solvent injected from the Surfsol solvent tank (152). The hot crude with a temperature range from 200-600° F. enters the reactor (108) through plurality nozzles and devices which reduces the molecular size of the crude to 10-120 microns.

The pressure inside the reactor (108) is at a range from less than 0-29 inches of Hg. The atomized crude particles inside the reactor (108) are sprayed into the vacuum condition at the pressure of 200-1000 psi and temperature of 200-600° F. results in spray-cracking and vacuum-flashing of the crude oil. This technique of spray-cracking and vacuum-flashing breaks the complex molecules or the heavy chain hydrocarbons into simpler or light chain molecules. The vacuum flashing of the crude drops the boiling point of the crude so the temperature of the crude reaches 300-80° C. at this stage. The lighter chains are carried out of the reactor (108) through the separator (122a) into the multi-stage horizontal reverse condensate condenser (112) and the heavier carbon chains are forced to drop to the sump (108a) of the reactor (108). The residuum is collected into the sump (108a) containing heavier carbon chain compounds, which are re-circulated back into the reactor using the re-circulating centrifugal or positive displacement pump (110) to further extract the lighter chains from the crude. The residuum collected in the sump (108a) of the reactor is sent for primary processing. The residuum is sent out from the sump (108a) of the reactor through the centrifugal or positive displacement pump (110) and heat exchanger (104). The primary processing involves the recirculation of residuum throughout the process to further extract the desired components from the crude oil. Further, the first residuum is sent for secondary processing by again re-circulating the first residuum to obtain a chemical-rich residuum. The secondary processing yields a highly concentrated chemical-rich residuum from which many chemicals, and industrial and consumer petroleum products may be derived. The heavier end chains collected in the sump (108a) of the reactor after the recycling process are pumped as bunker fuel (#4 diesel) and collected into the bunker fuel stock tank (136). The asphalt may also be extracted from the chemical-rich residuum, which is collected into the asphalt output storage tank (154). Other by-products like paraffin can be separated in liquid form and may be added with designer fuels like Bunker fuel, Jet fuel, Diesel fuel, and Gasoline fuel to impart beneficial characteristics to the fuels.

FIG. 1C illustrates the multi-stage horizontal reverse condensate condenser section and corresponding outputs from each stage. The vapor leaves the reactor (108) and enters the multi-stage horizontal reverse condensate condenser (112) containing at least three stages to separate the crude oil into targeted designer fuels. The vapor containing the C1-C4 carbon chain does not condense in the multi-stage horizontal reverse condensate condenser and these lighter chains may be recovered into the vapor trap tank (114). The vapor from the vapor trap tank (114) is drawn by the small blower (120c) through a separator (122b) to remove any entrapped gases. The small blower (120c) sends the gases from the vapor trap tank (114) into a vapor recovery unit (VRU) (126) to be burned by the process heaters (128). The methane and other vapor are circulated from the vapor trap tank (114) by the main blowers (120a, 120b). The pair of main blowers (120a, 120b) increases the velocity and pressure of the gases which are passed through the pair of methane heaters (124a, 124b) which uses thermal fluids, to raise the temperature of the gases equal to the temperature inside the reactor (108). The exhaust containing harmless gases that are released from the pair of methane heaters (124a, 124b) is opened into the atmosphere. This step will not result in the cooling of the reactor. The heated gases from the methane heaters (124a, 124b) enter the reactor (108) through the plurality of nozzles from the sides of the reactor (108). These gases pass through the reactor carrying the atomized crude particles along with them at the velocity range from 3-12 feet per second and reach a separator (122a) inside the reactor. The shorter carbon chain molecules are easily passed through the separator (122a), while longer carbon chain molecules hit the separator (122a) and fall into the sump (108a) of the reactor (108).

The vapor from the reactor (108) enters into the multi-stage horizontal reverse condensate condenser (112). The multi-stage horizontal reverse condensate condenser (112) may have three to four stages according to the targeted designer fuels that are to be produced. The multi-stage horizontal reverse condensate-condenser condenses sideways flowing vapors through the condenser tube, such that the targeted low temperature of the condenser condenses the remaining vapor and drops them into the bottom section compartments of the condenser corresponding to the different fuel fractions contained in the crude oil. The conventional distillation towers heat the boiled crude oil vapor to rise in the vertical distillation towers, which condenses to produce various vapor fractions of petroleum fuels.

On the other hand, in a reverse condensate condenser, the heated crude oil droplets are cooled in separate compartments, so that they fall and condense at targeted temperatures to produce targeted fuel products that can be collected in separate storage tanks. Since hot crude is cooled down as it crosses the condenser, compared to conventional oil refinery distillation columns that condense fuel as it rises, the Micro Crude Oil Refinery in the present invention uses a multi-stage horizontal reverse condensate condenser.

All the stages in the present invention as shown in FIG. 1C are targeted with the first stage taking the inlet temperature of the vapor from the reactor (200-600° F.) and condensing the vapor to a temperature range of 200-150° F. to produce diesel fuel (#2 diesel fuel) from the first stage of multi-stage horizontal reverse condensate condenser (112) which gets collected into the diesel stock tank (134). The cooling medium is obtained from the heat exchanger (104). The second stage takes the temperature 200-150° F. from the first stage and uses a fin fan (116) or similar products to condense the vapor to 170-50° F. to obtain kerosene or jet fuel which gets collected into a Kerosene/Jet fuel stock tank (132). Further, the third stage uses chillers (118) or similar products to reduce the temperature from the second stage (170-50° F.) to 60-20° F. to produce naphtha or gasoline fuel which is collected into a naphtha/gasoline stock tank (130). The targeted vapor that is condensed in respective stages collects into respective stock tanks are then pumped into targeted storage tanks.

FIG. 1D illustrates the outputs of designer fuels through the Gas Void Fraction (GVF) (138) centrifuges and Fraction Sulphur Reducer (FSR) (140) into the respective output storage tank of the process (100). The four to five fuel products extracted in the process are pumped from respective stock tanks using centrifugal or positive displacement pumps (110) into the GVF (138) density separator/centrifuge. The GVF is used as a polishing agent that targets final fuel molecule configurations by density effectively ejecting and removing all unwanted densities of impurities and contaminants that are attached to the targeted fuel molecules, which impurities/contaminants may degrade fuel performance and increase combustion emissions. The centrifuge polishing removes these unwanted attachments from hydrocarbon fuel molecules, thereby preventing them from being combusted to release toxic emissions into the atmosphere. When light crude oil is used as crude oil feedstock, the process will generate #4 diesel fuel, #2 diesel fuel, kerosene/jet fuel, Naphtha, and gasoline fuel. These fuel products from the respective stock tanks are pumped through the gas void fraction (GVF) (138) centrifuges and may be re-circulated back into their respective stock tanks controlled through valves. The GVF (138) centrifuges remove unwanted carbon chain impurities based on the desired density of the fuel. The fuel products come in contact with desulfurization ester additives in the FSR (140) to remove unwanted pollutants. The additives reduce SOx emissions by up to 40% and reduce NOx emissions by up to 10%. The bunker fuel from the bunker fuel stock tank (136) is pumped through the GVF (138) and re-circulated to remove unwanted pollutants with C20 carbon chain and below carbon chain and also C50 and above carbon chains and then passed through FSR (140) and stored in the bunker (#4 diesel) fuel output storage tank (150). The diesel fuel (#2 diesel fuel) from the diesel stock tank (134) is pumped through the GVF (138) and re-circulated to remove unwanted pollutants with C16 and below carbon chains and also C20 and above carbon chains which then passed through FSR (140) and stored in diesel output storage tank (148). The Jet fuel or kerosene fuel from the Jet fuel/kerosene stock tank (132) is pumped through the GVF (138) and re-circulated to remove unwanted pollutants with C10 and below carbon chain and also C16 and above carbon chains which then passed through FSR (140) and stored in Jet fuel/Kerosene output storage tank (146). Naphtha or gasoline fuel from the naphtha or gasoline stock tank (130) is pumped through the GVF (138), followed by FSR (140), and further sent into two separate storage tanks, one is the gasoline output storage tank (144) and the other is naphtha output storage tank (142). The gasoline output storage tank (144) will remove the unwanted pollutants with C4 and below carbon chains and also C9 and above carbon chain which is sent to the naphtha output storage tank (142). These designer fuel products may be directly pumped through the GVF (138) and FSR (140) to a truck for sale or may be stored in respective storage tanks to be used for various applications. These designer fuels pumped through the GVF (138) pass through a fraction sulfur reducer (FSR) (140) to remove most of the sulfur in the fuel product and are stored in respective storage tanks which may be sent for sale to wholesale market and retail customers. These higher-purity, cleaner-burning designer fuels with increased gas mileage burn cleaner, cooler with reduced per-gallon emissions of SOx, NOx, and other unwanted gases.

Figure 2:
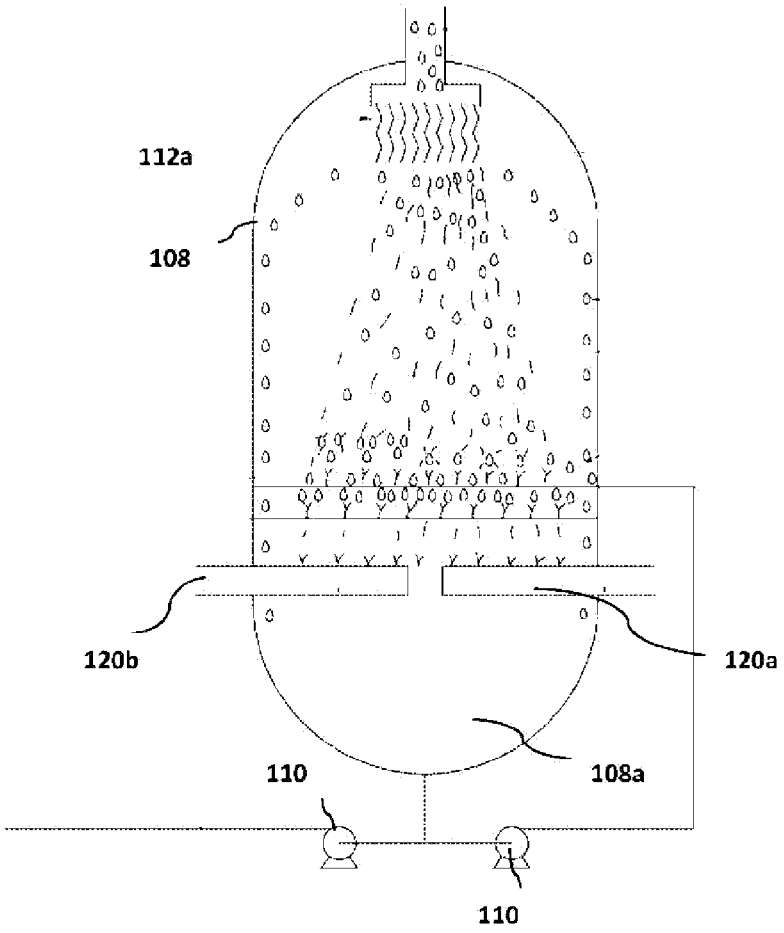
FIG. 2 illustrates the reactor used in the crude oil refining process according to an embodiment herein.

FIG. 2 illustrates a diagram of the reactor (108) used in the crude oil refining process (100) to separate designer fuels according to an embodiment herein. The hot crude oil from the crude stage enters the reactor (108) through the plurality of nozzles and other devices, where the pressure inside the reactor is 0-29 inches of Hg and gets converted into atomized crude droplets of particle sizes of 10-120 microns. The vapor from the vapor trap tank (114) enters the reactor (108) through the pair of main blowers (120a, 120b). The vapor carries the atomized crude particles at a velocity of 3-12 feet per second to the separator (122a) located inside the reactor (108), where the atomized crude particles and the vapor are forced to fall into vacuum condition at the pressure of 200-1000 psi, which results in spray-cracking and vacuum-flashing at a pressure of 1000 psi. The spray-cracking and vacuum-flashing technique reduces hydrocarbon molecule sizes more efficiently and uses less energy than conventional refineries to crack hydrocarbons. The light short chains pass through the separator (122a) and are further passed into the multi-stage horizontal reverse condensate condenser (112). The separator (122a) forces the heavy long-chain carbon to fall through the sides of the reactor and get collected into the sump (108a) of the reactor. The long-chain carbon compounds collected in the sump (108a) are re-circulated back into the reactor using a centrifugal or positive displacement pump (110) for further recovery of the light chain ends. After the recycling step, the bunker fuel (#4 diesel fuel) and the asphalt are finally extracted.

The present invention discloses a process that is a combination of chemical, kinetic, and heat-based energy-efficient crude oil separation into higher-purity, cleaner-burning designer fuels with reduced emissions. The chemical process mixes viscosity-reductant additives, like the solvent, "Surfsol", with crude oil to separate long-chain hydrocarbon bonds that connect heavy asphaltenes, paraffin crystals, and aromatic "contaminants" to the crude oil carbon chains. This treatment reduces the processing load by returning the lighter-end hydrocarbons into solution for further processing by subsequent kinetic and heat-based crude oil separation into shorter-chain hydrocarbon fuels. The kinetic process of Surfsol treatment is achieved by centrifugal or positive displacement circulating pumps which mix the input crude oil with the chemical additives and the crude oil, causing the aromatics to drop out the impurities from the lighter-ends, producing high-purity, high-value shorter-chain hydrocarbon fuels that burn cooler and more efficiently. Using Surfsol solvent as the crude oil viscosity-reductant additive is one of the cheapest ways to treat asphaltenes and paraffins, compared to conventional energy-intensive refineries that require ultra-high temperatures and pressures. The insertion of GVF centrifuges causes centrifugal polishing of the designer fuels to only contain shorter carbon chains C1-C5 and remove longer >C24 carbon chains and other undesired impurities attached to the hydrocarbon molecules. The advanced centrifuges operate by density differentials. It may have a dial-in control panel in the GVF centrifuges to produce output fuel with desired density values by knocking out every molecule in the stream that does not have the density of the desired molecules. The post-treatment with ester additives removes SOx, NOx, and other remaining contaminants. The heat-based process in the present invention takes place at a temperature less than 550° F. and <20-psi operating pressure flashes off the last remaining gaseous hydrocarbon fractions from the heavy oil residuum into higher-purity fuels at lower pressures and temperatures than conventional high-pressure >900-psi and high-temperature >1100° F. crude oil refinery using fractionation distillation methods.

The crude oil molecules generally require electrons to be in a state of equilibrium. The conditioned Surfsol chemical additive is usually made with surfactants and conditioned water, where the conditioned fluid acts as the carrier fluid. The Surfsol solvent mechanically receives electrons from the electric current generated in real-time by the movement of the fluid through the mechanical conditioner. The Surfsol solvent converts hydrophilic oil attached to water molecules into hydrophobic oil that prevents oil molecules from bonding with water. In cases when the water molecules in conditioned fluids are overcharged with electrons, the fluid molecules will give off or donate to other deficient water molecules or go to the ground, such that the fluid's molecular electrons attain a state of equilibrium. On the other hand, when water molecules in Surfsol solvent are electron-deficient, the water will absorb electrons from the ground; such that the water's molecular electron state can be in equilibrium. The harmonic balance of water electrons allows water molecules to shrink to small and round sizes, which enables the water molecules to carry more Surfsol chemical additives and increase contact with the crude oil molecules. The harmonic balance of water electrons in Surfsol solvent breaks the emulsion of water-surrounding oil molecules so that the surfactant can penetrate and break the hydrocarbon bonds holding onto the asphaltenes, paraffin, and aromatic molecules, releasing these molecules from the surrounding water molecules at ambient temperature without any costly heat expenditure to condense the water from the oil. The conditioned water penetrates the emulsion surrounding the crude and breaks off the paraffin and asphaltene molecules producing higher-purity hydrocarbon molecules in the process.

The process produces high-purity designer fuel based on the input density of crude oil and the desired output densities of the designer fuels. The process may manipulate the densities of each of the fluids passing through the process beginning from the input crude oil densities to the desired preferred output fuel densities to obtain high-purity commercial fuels in the industry with low-price of production.

The entire crude oil refining process of producing higher-purity, cleaner-burning designer fuels from the crude oil does not release any harmful emissions into the atmosphere. The lighter-end C1-C4 aromatic gases recovered in the process are used as cleaner-burning fuel to burn the process's heaters, whose combustion exhaust gases are vented to the atmosphere. The methane or Utility-grade natural gas-fired process heater is the only component in the process that vents its combusted exhaust gas to the atmosphere (less than 7 ppm NOX). In the situation when there are no sufficient amounts of aromatics contained in the crude oil to extract, then to make up for such a shortfall, the process may open valves for utility-delivered natural gas to run the heater. The aromatics may then be added to the utility gas at a higher pressure. Thus, this process has an excellent gas recycling step than other conventional methods, which enables efficient utilization of energy.

Figure 3:
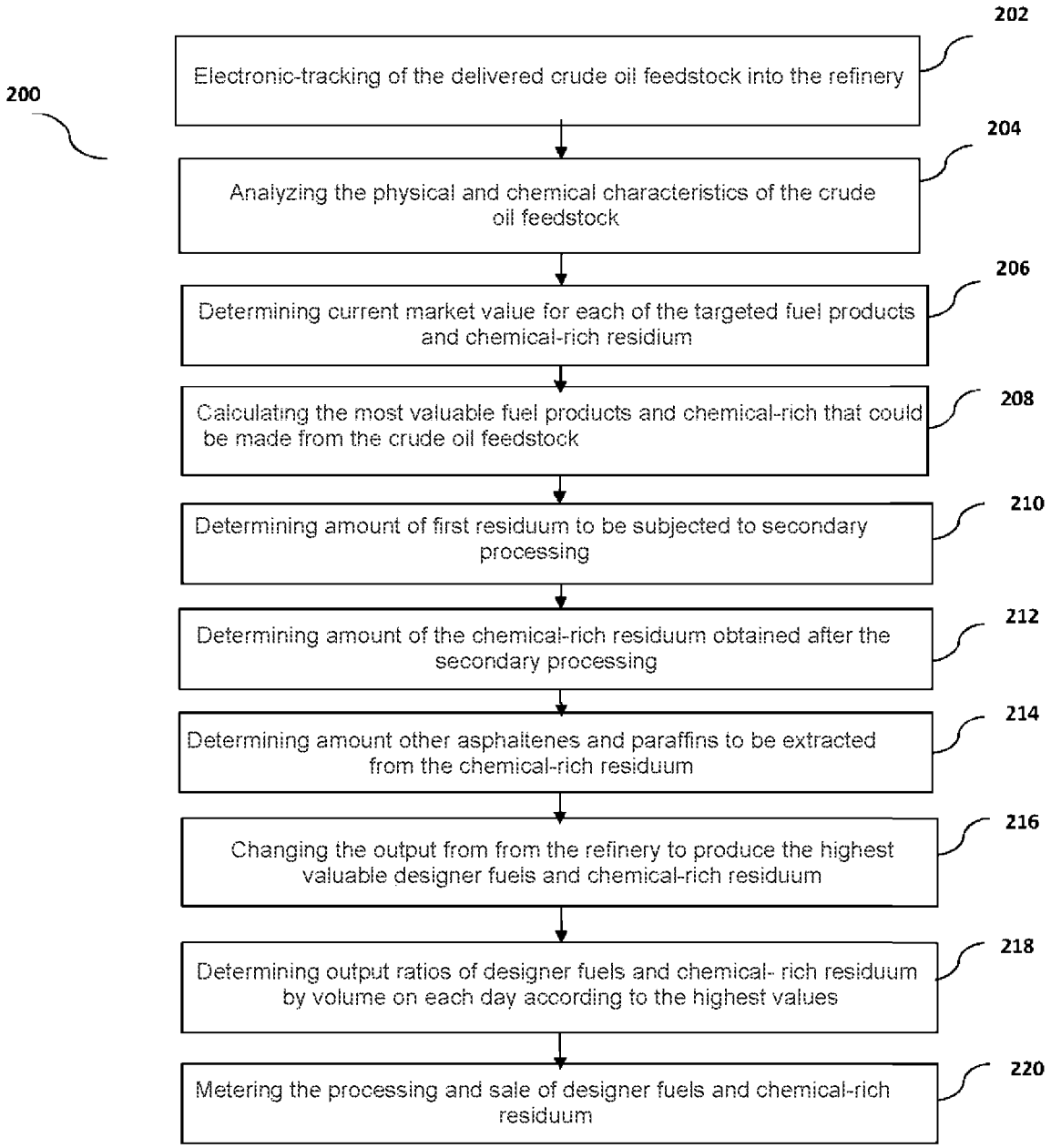
FIG. 3 illustrates a flow chart that illustrates the method of automating the daily selection of the designer fuels and chemical-rich residuum from the process.

FIG. 3 is a flowchart that illustrates the automation method (200) using a production auditing or accounting control system operated with a software program that measures, records, and counts the crude oil and additive volumes entering the facility and the output of the higher-purity, cleaner-burning designer fuels. The first step is electronic tracking of the delivered crude oil feedstock into the stock tanks of the refinery (202). The next step is analyzing the physical and chemical characteristics of the crude oil feedstock (204). The physical and chemical characteristics of the crude oil feedstock include Viscosity, API Gravity, Sulfur-content, Paraffin-content, Asphaltene-content, Aromatics-content, Water-content, Sediment-content, vanadium-content, nickel-content. Based on these characteristics, the automation process determines the constituent contents that may be removed from the crude oil and determines the amount of higher-purity, cleaner-burning designer fuels, and their composition that can be produced. Further, determining the amount of heavy oil residuum and unwanted crude oil impurities and contaminants left over after the production of these designer fuels. These characteristics also assist in calculating the heat and pressure requirement for the process, the thicker crude oil generally requires more heat and pressure to move through the pipes. It is followed by determining the current market value and the price trends of each of the targeted fuel products and chemical-rich residuum (206). The next step is calculating the most valuable fuel products that could be made from crude oil feedstock based on the analyzed characteristics of crude oil feedstock and price trends (208). By cross-checking the real-time commodity price of each of the fuels, which may be bunker, jet, diesel, or gasoline fuel to determine which fuel has the best price for the refinery to make the maximum sales revenue by producing the most in-demand highest-value fuel of the day. Further, it determines the amount of the first residuum to be subjected to secondary processing (210) and followed by determining the amount of the chemical-rich residuum obtained after the secondary processing (212). It calculates the amount of the asphaltenes and paraffins to be extracted from the chemical-rich residuum (214). The next step is changing the output from the crude oil refinery to produce the highest valuable fuel product and the chemical-rich residuum which is calculated in percentage ranges (216). The output ratios of the fuel products and chemical-rich residuum by volume are measured each day according to the highest valuable fuel product that generates the maximum sale for the day (218). Finally, metering the processing and sale of higher-purity, cleaner-burning designer fuels and chemical-rich residuum (220) is carried out by recording the weights and/or volumes of crude oil inputs, Surfsol solvent additive inputs, desulfurization ester additive inputs, electrical and thermal energy inputs, and corresponding fuel product and chemical by-product outputs. The identification is done using dye color or components for online purchases of the designer fuels which are to be barrelled. The designer fuels may be sold to wholesale markets or retail customers. The fuels may also be sold in the online market by speculators who want the fuel as collateral or may be sold to actual customers who are anxious about oil and gas supplies being interrupted during an emergency and want to use corporate fleet service to bring lower-cost wholesale gas prices to retail store customers.

Figure 4:
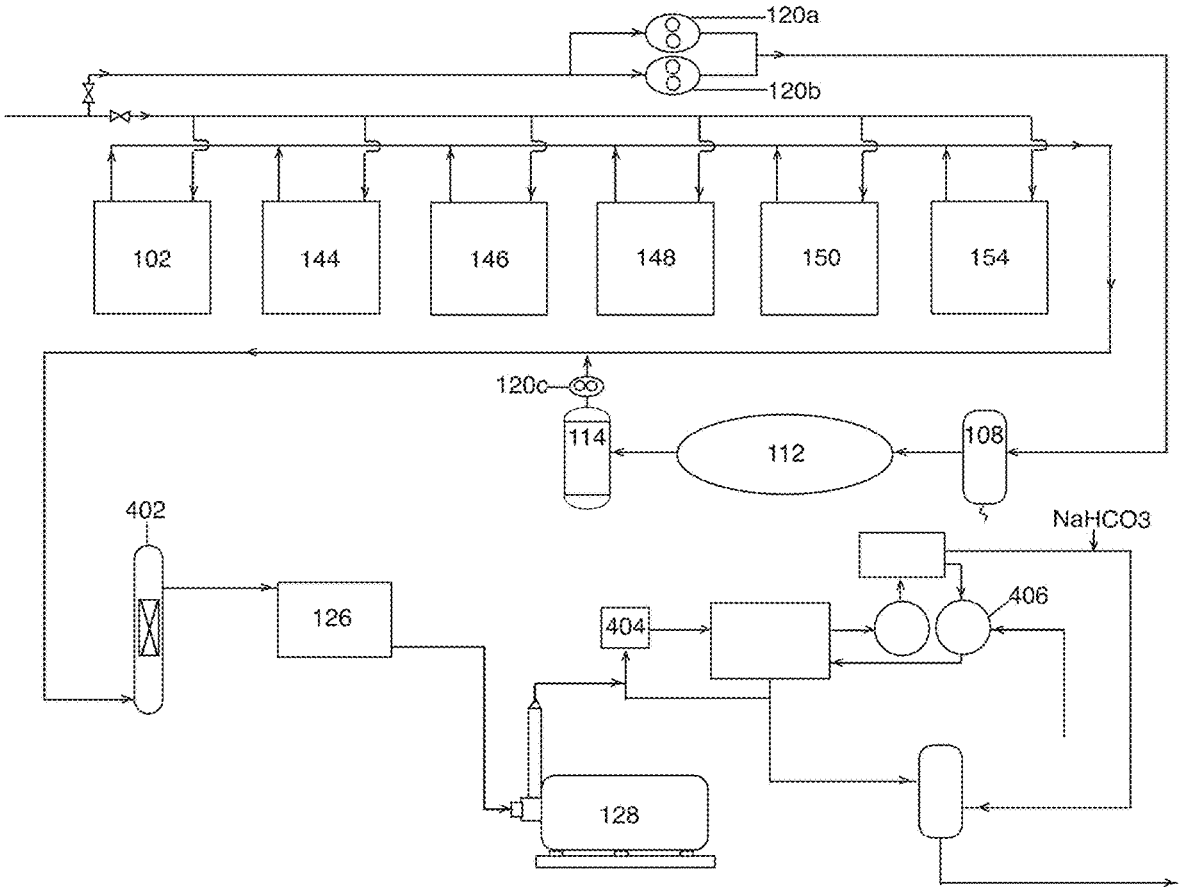
FIG. 4 illustrates natural gas makeup, tank blanketing, and vapor recovering units supplying excess gases and natural gas to the process heaters. Showing the process heaters flue gases being CO2 sequestered, mineralization, or other methods of CO2 removal.

FIG. 4 illustrates a diagram FIG. 4 illustrates a diagram of the flow of natural gas and excess gas from the process. Natural gas is used as a makeup gas to be used as a carrier gas for the process and is injected at the suction to main blowers (120a & 120b). Natural gas is also used to place a gas blanket on crude tank 102, gasoline tank 144, kerosene/jet fuel tank 146, diesel tank 148, fuel oil tank 150, and asphalt tank 154 thus preventing the release of toxins to the atmosphere. As produce is pumped out of the tank more gas is admitted to the tank to maintain a positive pressure on the tank preventing emissions from escaping from the tanks. As product is added to tanks the gas is released to the vapor recovery system to maintain the proper pressure on the tanks. The vapor recovery unit 126 takes suction on the vapor recovery system through a scrubber 402. The scrubber 402 or other devices will remove water and unwanted gases such as $H_2S$ from the gas stream. The pressure of the gas is increased by a compressor in the vapor recovery unit 126 and the gases are pumped to the suction of the thermal heater 128. Blower 120c takes the extra gas from the vapor trap tank 114 and pumps the gas into the natural gas stream to thermal heater 128 where the natural and process gases are burned. The flue gases from the thermal heater are directed to a flue gas cooler 404 in preparation for $CO_2$ capture. Flue gas passes through a bath of seawater, producing water, solvent, or brine 406 to absorb the $CO_2$ gas. From there the $CO_2$ is converted into Sodium Bicarbonate. The Sodium Bicarbonate is in turn used to remove the last remnants of other harmful substances from the flue gases.

Figure 5:
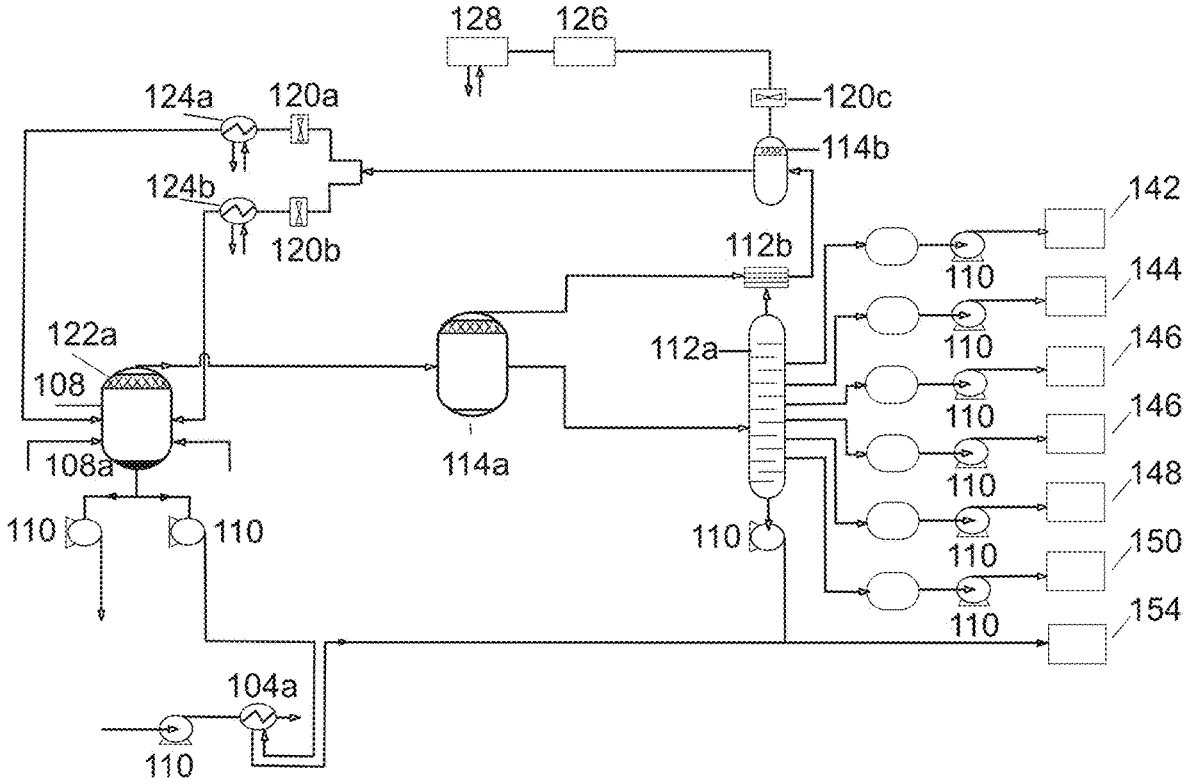
FIG. 5 illustrates a process flow diagram illustrating the section of the initial vapor from the reactor through the distillation tower and back to the reactor with the corresponding outputs from each stage of the distillation tower and the crude preheating using asphalt from the reactor sump.

FIG. 5 is a process flow diagram illustrating the section encompassing the initial vapor from the reactor through the distillation tower and back to the reactor with the corresponding outputs from each stage of the distillation tower and the crude preheating using residuum from the reactor sump. Vapor from the reactor (108) enters the distillation tower (112a) under vacuum, and the light fractions rise to their condensable levels and are collected in a plurality of fractionation trays. The naphtha fuel is condensed and collected in the naphtha product tank (142). The gasoline fuel is condensed and collected in the gasoline product tank (144). The jet fuel is condensed and collected in the jet fuel product tank (146). The kerosene fuel is condensed and collected in the kerosene product tank (146). The diesel is condensed and collected in the diesel product tank (148). The bunker fuel is condensed and collected in the bunker fuel product tank (150). The heavier long-chain hydrocarbons fall to the bottom of the distillation tower (112a) and are pumped with a centrifugal or positive displacement pump (110) into the asphalt stream from the reactor (108) to the asphalt product tank (154).

The closed loop of the MOR process, the blanketing of tanks, and the capturing, sequestering, and mineralization of heater flue gases make this system zero emissions.

Moreover, the automation process calculates the amount of high-value fuel and chemical-rich residuum that is generated in the process by following steps: initially testing the mass, volume make-up, and the characteristics of the input crude oil feedstock. It is then followed by calculating the total volume of finished output fuels producible from the given amount of input crude oil. Then, subtracting the aggregated volume and weight totals of components comprising the output designer fuels. The next step is equating the volume and weight of all the left-over chemicals and carbon chains in the heavy oil waste residuum. The primary processing of the heavy oil residuum is carried by recycling, where the lighter ends are further removed by retreatment with crude oil, emulsion, and aromatics. Then, based on the amount of chemical leftovers in the residuum, the process calculates the amount of higher-value finished fuels that can be produced by secondary processing of the residuum. The secondary processing of the heavy ends completely releases and extracts as many recoverable light-ends and carbon chain fuels as are present in the first residuum. Thus, the secondary processing yields more finished fuels and highly concentrated chemical-rich residuum which can be used as hot or cold road asphalt.

In addition, the process calculates the amount of leftover asphaltenes that can be obtained from the chemical-rich residuum. It also calculates the amount of left-over paraffin that may be obtained from the heavy oil residuum and may use this paraffin in liquid form to add beneficial characteristics to fuels like bunker, jet, gasoline, and diesel fuel. The final processing for extraction of remaining light-ends, paraffin, and asphaltenes from the first residuum of processed crude oil produces a more highly-concentrated and higher-density secondary residuum containing higher-value chemicals that can be extracted by third-parties using tertiary residuum separation processes.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for description and not for limitation. Therefore, while the embodiments herein have been described in terms of preferred embodiments, those skilled in the art will recognize that the embodiments herein can be practiced with modification within the spirit and scope of the appended claims.

EXAMPLES

Example 1: The table as shown below is an example, illustrates the breakdown of the higher-purity, cleaner-burning designer fuels (in %) that may be produced from the process, when light crude oil having >27 API gravity is used as the input crude oil feedstock. The ratio amounts of different fuels produced in the process are completely based upon the characteristics of the input crude oil, including viscosity, gravity, sulfur content, asphaltene content, and paraffin content. Based on these parameters, the automation process calculates the most optimal mix of output fuel depending on the real-time price and demands of the fuels. If the input crude oil has an API of <15-gravity, which Isa very heavy and thick crude oil, that would produce >60% of its volume as Asphalt and <40% for fuels. If the Crude oil has an API of >25 gravity, which is light crude oil, then that will produce a wide range of fuels as shown in the table below. This table may be used for determining profits and the amounts of ester additives to be added to the finished fuels.

TABLE 1

Annual fuel production ratios from the process
ANNUAL FUELS PRODUCTION RATIOS

| | % of Output | Finished Fuel | Gal. Produced |
|---|---|---|---|
| 3,600,000 Barrels of Input Crude Oil | 5% | Residuum Bitumen/Asphalt | 7,560,000 |
| | 10% | Bunker Fuel Red Diesel | 15,120,000 |
| 151,200,000 Gallons of Bunker/Jet/Diesel/Gasoline Produced Fuels Output | 35% | #2 Diesel Heating Oil | 52,930,000 |
| | 30% | Jet Fuel A/B Naptha | 43,360,000 |
| | 20% | Gasoline | 30,240,000 |
| % of Production | 100% | Total Gallons Produced | 151,200,000 |

Example 2: Table 2 as shown below discloses the density ranges of the designer fuels and the by-products that may be produced in the process from the given input of crude oil feedstock based on the physical and chemical characteristics of the input crude oil. The separated hydrocarbon fuel product is considered to be "pure" if the recovered hydrocarbon components have the same or substantially the same density range defining that component.

As shown in Table 2, gasoline having a density range of 45-49 lb/ft3 or 715-780 kg/m3 is therefore considered to be a "pure" fuel product. The high-purity output fuels produced in the process are produced by using the centrifuge settings to separate the hydrocarbon chains having the dialed-in or preferred density value that defines a high-purity bunker, jet, diesel, and gasoline fuel with little or no contaminants attached to the hydrocarbon molecules.

TABLE 2

Density ranges of the designer fuels and the by-products produced in the process

| | Density @15° C. P | | Specific Volume V | |
|---|---|---|---|---|
| Fuel | (kg/m 3) | (lb/ft 3) | (m 3/1000 kg) | (ft 3/per ton) |
| Butane (gas) | 2.5 | 0.16 | 400 | 14100 |
| Coke | 375-500 | 23.5-31 | 2.0-2.7 | 72-95 |
| Diesel 1D | 875 | 54.6 | 1.14 | 40.4 |
| Diesel 2D | 849 | 53 | 1.18 | 41.6 |
| Diesel 3D | 959 | 59.9 | 1.04 | 36.8 |
| EN 590 Diesel | 820-845 | 51-53 | 1.18-1.22 | 42-43 |
| Fuel oil No. 1 | 750-850 | 47-53 | 1.2-1.3 | 42-47 |
| Fuel oil No. 2 | 810-940 | 51-59 | 1.1-1.2 | 38-44 |
| Gas oil | 825-900 | 51-56 | 1.1-1.2 | 38-44 |
| Gasoline | 715-780 | 45-49 | 1.3-1.4 | 45-49 |
| Heavy fuel oil | 800-1000 | 50-63 | 1.0-1.3 | 42-46 |
| Kerosene | 775-840 | 48-52 | 1.2-1.3 | 42-46 |
| Natural gas (gas) | 0.7-0.9 | 0.04-0.06 | 1110-1430 | 39200-50400 |
| Propane (gas) | 1.7 | 0.11 | 590 | 20800 |

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for description and not for limitation. Therefore, while the embodiments herein have been described in terms of preferred embodiments, those skilled in the art will recognize that the embodiments herein can be practiced with modification within the spirit and scope of the appended claims.

We claim:

1. A system for refining crude oil to minimize emissions of toxic compounds into the atmosphere during refining, the system comprising a crude section comprising:

a crude oil stock tank for storing crude oil feedstock;

a plurality of heat exchangers configured to heat crude oil coming from the crude oil stock tank to an optimum temperature range;

a chemical additive tank configured to store a viscosity-reductant additive to be contacted with the crude oil to breakdown heavy chain hydrocarbons in the crude oil to light chain hydrocarbons;

a plurality of centrifugal pumps or a positive displacement pump, configured to mix the crude oil with the viscosity-reductant additive;

a reactor configured and operative for spray-cracking and vacuum flashing of the crude oil to separate out the heavy chain hydrocarbons, the light chain hydrocarbons and by-products; and a plurality of valves configured to control the a flow of crude oil through the plurality of heat exchangers to the reactor;

a condensate section comprising:

a closed-loop vertical distillation tower configured to receive vapor of the light chain hydrocarbons from the reactor, wherein the vapor of the light chain hydrocarbons enters the closed-loop vertical distillation tower under vacuum and light fractions rise to their condensable level and are collected in a plurality of different fractionation trays as targeted fuel products and pass on non-condensed vapor and gases;

a plurality of fuel stock tanks, each configured to collect a corresponding one of the targeted fuel products;

a plurality of gas void fraction (GVF) centrifuges, each configured to operate by density differentials and centrifugal polishing to separate targeted fuels of desired density value and hydrocarbon molecules of desired purity values; and a plurality of output storage tanks, each configured to store respective targeted fuel products and by-products before being sent for sales;

a vapor section comprising:

a vapor trap tank configured to collect the non-condensed vapor and gases passed on from the closed-loop vertical distillation tower;

a plurality of blowers, each configured to draw at least a portion of the non-condensed vapor and gases from the vapor trap tank and increase velocity and pressure thereof;

a plurality of methane heaters, each configured to receive the portion of the non-condensed vapor and gases from a corresponding one of said blowers and to heat the received portion for re-circulation into the reactor;

a separator configured to remove any non-condensable gases from the non-condensed vapor and gases collected in the vapor trap tank; and a process heater, configured to receive the non-condensable gases from said separator, through a vapor recovery unit, and burn the non-condensable gases; and a flue-gas sequestration section configured to sequester heater flue gases received from the process heater through high-salinity fluids to capture, sequester, or mineralize CO2, CO, NOx, or other contaminants from the heater flue gases.

2. The system as claimed in claim 1, wherein the heater flue gases from the process heater are passed to a gas cooler prior to sending the heater flue gases through the high-salinity fluids for sequestering the heater flue gases.

3. The system as claimed in claim 1, wherein the CO2, CO, and gases from the heater flue gases are converted into sodium bicarbonate in the flue-gas sequestration section.

4. The system as claimed in claim 1, wherein the vapor section comprises a scrubber to draw in the non-condensed vapor and gases through suction for removing water and unwanted gases from the non-condensed vapor and gases.

5. The system as claimed in claim 1, wherein the high-salinity fluids comprise a seawater, a groundwater, a solvent, or a brine.

6. A system for refining crude oil to minimize emissions of toxic compounds into the atmosphere during refining, the system comprising a crude section comprising:

a crude oil stock tank for storing crude oil feedstock;

a plurality of heat exchangers configured to heat crude oil coming from the crude oil stock tank to an optimum temperature range;

a chemical additive tank configured to store a viscosity-reductant additive to be contacted with the crude oil to breakdown heavy chain hydrocarbons in the crude oil to light chain hydrocarbons;

a plurality of centrifugal pumps or a positive displacement pump, configured to mix the crude oil with the viscosity-reductant additive;

a reactor configured and operative for spray-cracking and vacuum flashing of the crude oil to separate out the heavy chain hydrocarbons, the light chain hydrocarbons and by-products; and a plurality of valves configured to control a flow of crude oil through the plurality of heat exchangers to the reactor;

a condensate section comprising:

a closed-loop vertical distillation tower configured to receive vapor of the light chain hydrocarbons from the reactor, wherein the vapor of the light chain hydrocarbons enters the closed-loop vertical distillation tower under vacuum and light fractions rise to their condensable level and are collected in a plurality of different fractionation trays as targeted fuel products and pass on non-condensed vapor and gases;

a plurality of fuel stock tanks, each configured to collect a corresponding one of the targeted fuel products;

a plurality of gas void fraction (GVF) centrifuges, each configured to operate by density differentials and centrifugal polishing to separate targeted fuels of desired density value and hydrocarbon molecules of desired purity values; and a plurality of output storage tanks, each configured to store respective targeted fuel products and by-products before being sent for sales;

a vapor section comprising:

a vapor trap tank configured to collect the non-condensed vapor and gases passed on from the closed-loop vertical distillation tower;

a plurality of blowers, each configured to draw at least a portion of the non-condensed vapor and gases from the vapor trap tank and increase velocity and pressure thereof;

a plurality of methane heaters, each configured to receive the portion of the non-condensed vapor and gases from a corresponding one of said blowers and to heat the received portion for re-circulation into the reactor;

a separator configured to remove any non-condensable gases from the non-condensed vapor and gases collected in the vapor trap tank; and a process heater, configured to receive the non-condensable gases from said separator, through a vapor recovery unit, and burn the non-condensable gases; and a flue-gas sequestration section configured to sequester heater flue gases received from the process heater to capture, sequester, or mineralize CO2, CO, NOx, or other contaminants from the heater flue gases.

7. A system for refining crude oil to minimize emissions of toxic compounds into the atmosphere during refining, the system comprising a crude section comprising:

a crude oil stock tank for storing crude oil feedstock;

a plurality of heat exchangers configured to heat crude oil coming from the crude oil stock tank to an optimum temperature range;

a chemical additive tank configured to store a viscosity-reductant additive to be contacted with the crude oil to breakdown heavy chain hydrocarbons in the crude oil to light chain hydrocarbons;

a plurality of centrifugal pumps or a positive displacement pump, configured to mix the crude oil with the viscosity-reductant additive;

a reactor configured and operative for spray-cracking and vacuum flashing of the crude oil to separate out the heavy chain hydrocarbons, the light chain hydrocarbons and by-products; and a plurality of valves configured to control a flow of crude oil through the plurality of heat exchangers to the reactor;

a condensate section comprising:

a vertical distillation tower configured to receive vapor of the light chain hydrocarbons from the reactor, wherein the vapor of the light chain hydrocarbons is collected as targeted fuel products and pass on non-condensed vapor and gases;

a plurality of fuel stock tanks, each configured to collect a corresponding one of the targeted fuel products;

a plurality of gas void fraction (GVF) centrifuges, each configured to operate by density differentials and centrifugal polishing to separate targeted fuels of desired density value and hydrocarbon molecules of desired purity values; and a plurality of output storage tanks, each configured to store respective targeted fuel products and by-products before being sent for sales;

a vapor section comprising:

a vapor trap tank configured to collect the non-condensed vapor and gases passed on from the vertical distillation tower;

a plurality of blowers, each configured to draw at least a portion of the non-condensed vapor and gases from the vapor trap tank and increase velocity and pressure thereof;

a plurality of methane heaters, each configured to receive the portion of the non-condensed vapor and gases from a corresponding one of said blowers and to heat the received portion for re-circulation into the reactor;

a separator configured to remove any non-condensable gases from the non-condensed vapor and gases collected in the vapor trap tank; and a process heater, configured to receive the non-condensable gases from said separator, through a vapor recovery unit, and burn the non-condensable gases; and a flue-gas sequestration section configured to sequester heater flue gases received from the process heater through high-salinity fluids to capture, sequester, or mineralize CO2, CO, NOx, or other contaminants from the heater flue gases.

* * * * *